US006216369B1

(12) United States Patent
Wolf et al.

(10) Patent No.: US 6,216,369 B1
(45) Date of Patent: Apr. 17, 2001

(54) STEAM IRON WITH STEAM DISCHARGE AHEAD OF AND ALONG THE SIDE OF THE IRON

(75) Inventors: Jürgen Wolf, Kriftel (DE); Antonio Rebordosa, Sant Fruitos de Bages (ES); Desideri Falco, Barcelona (ES); Candelario Martinez, Hospitalet del Llobregat (ES); Juan Carlos Coronado; Miguel Vazquez-Palma, both of Barcelona (ES); Remedios Pozo-Marin, Esplugas de Llobregat (ES); Sergi Gili, El Prat de Llobregat (ES)

(73) Assignee: Braun Aktiengesellschaft, Frankfurt (DE)

( * ) Notice: Subject to any disclaimer, the term of this patent is extended or adjusted under 35 U.S.C. 154(b) by 0 days.

(21) Appl. No.: 09/148,841

(22) Filed: Sep. 4, 1998

(30) Foreign Application Priority Data

Sep. 5, 1997 (EP) ..... 97115418

(51) Int. Cl.[7] ..... D06F 75/20
(52) U.S. Cl. ..... 38/93
(58) Field of Search ..... 38/93, 74, 77.1, 38/77.83, 80, 81, 97

(56) References Cited

U.S. PATENT DOCUMENTS 1,674,092 * 6/1928 Brewer .
2,729,004 * 1/1956 Swanson ..... 38/93
2,846,793 * 8/1958 Studer ..... 37/93 X
3,407,521 * 10/1968 English .
3,722,117 * 3/1973 Davidson .
3,738,033 * 6/1973 Busby .
4,642,922 * 2/1987 Prudenziati ..... 38/81
4,658,520 * 4/1987 Henneberger et al. ..... 38/93
5,165,184 * 11/1992 Gardaz et al. ..... 38/93
5,592,763 * 1/1997 Hahnewald et al. ..... 38/93 X

FOREIGN PATENT DOCUMENTS 41 33 295 * 4/1993 (DE) .
1201376 * 12/1985 (SU) .

* cited by examiner

*Primary Examiner*—Ismael Izaguirre
(74) *Attorney, Agent, or Firm*—Fish & Richardson P.C.

(57) ABSTRACT

The invention is directed to a steam iron with a water reservoir for the supply of water to an evaporation chamber in which the fed water is convertible into steam and which is connectable to at least one first and one second steam discharge port (18, 15), with a heating element (14) for heating both the evaporation chamber and a soleplate (1–12, 46), said soleplate having an ironing surface (39) and a nose (20) at its forward end when viewed in the direction of movement, and said first steam discharge port (18) being arranged in such close proximity to the iron's nose (20) that the steam propagates in the area adjacent to the iron's nose (20). The first and the second steam discharge port (18, 15) are formed in the soleplate (1–12, 46) such as to be at a height of less than 10 mm relative to the ironing surface (39). Further, the first and the second steam discharge port (18, 15) are in balanced pressure communication with each other. Provision is made for distinct steaming and drying zones.

17 Claims, 12 Drawing Sheets

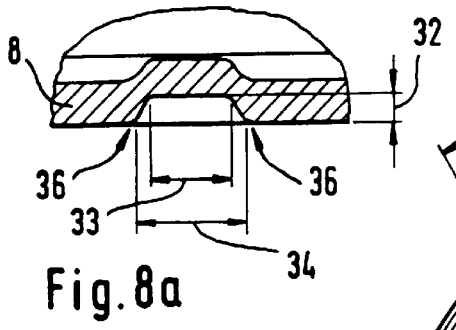
Fig. 8a
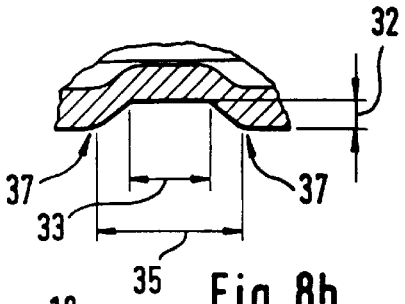
Fig. 8b
Fig. 8
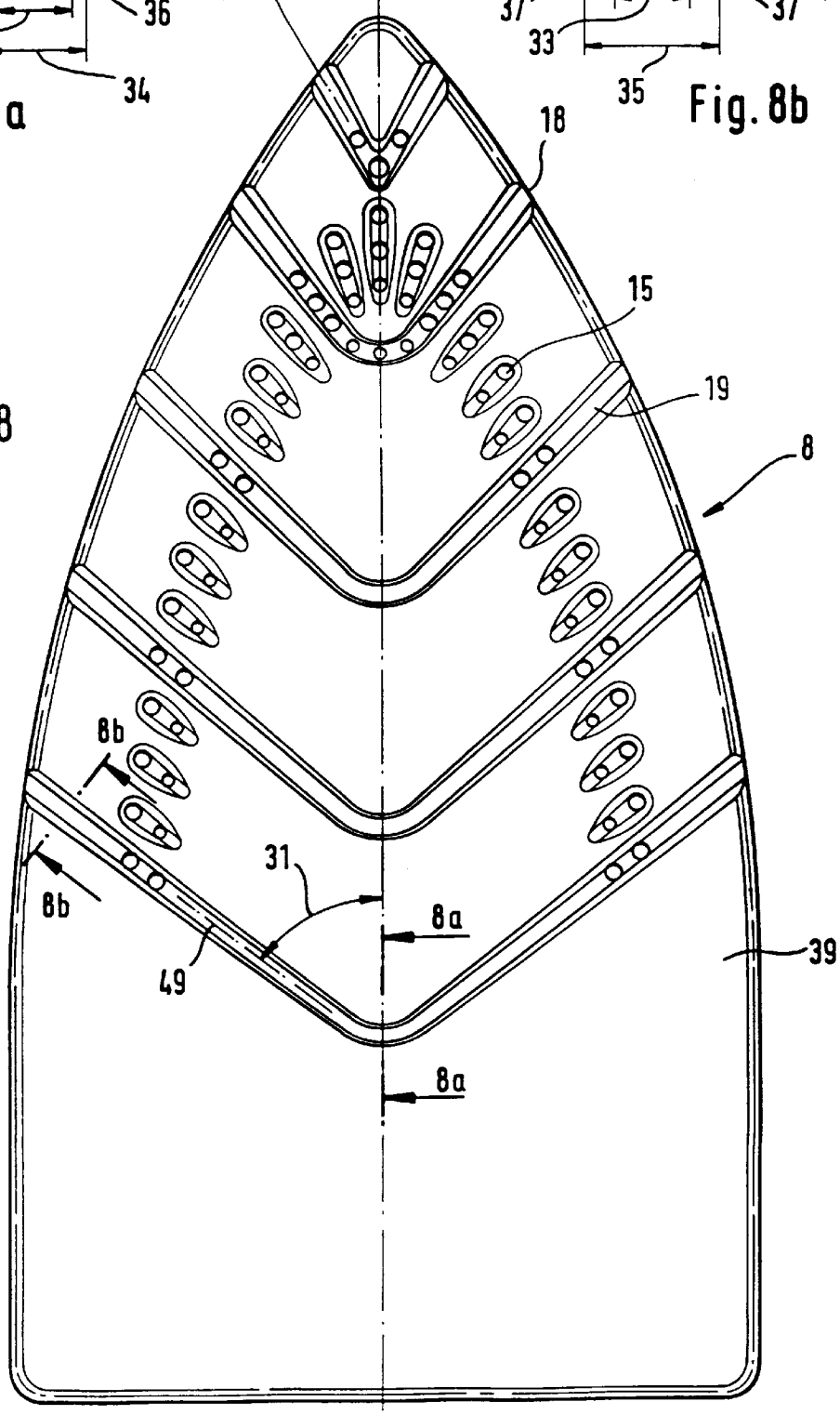

STEAM IRON WITH STEAM DISCHARGE AHEAD OF AND ALONG THE SIDE OF THE IRON

This invention relates to a steam iron with a water reservoir for the supply of water to an evaporation chamber in which the fed water is convertible into steam and which is connectable to at least one first and one second steam discharge port, with a heating element for heating both the evaporation chamber and a soleplate, said soleplate having an ironing surface and a nose at its forward end when viewed in the direction of movement, and said first steam discharge port being arranged in such close proximity to the iron's nose that the steam propagates in the area adjacent to the iron's nose.

It is generally known in the art that steam ironing is capable of producing a significantly better smoothing result on the material being ironed than dry ironing. Conventional steam irons include a plurality of steam discharge ports on the underside of the soleplate for dampening the material being ironed with steam directly underneath the soleplate. As a rule, however, steam applied in this manner is heated to a very high temperature, impinging on an article that is equally heated to a high temperature, so that the steam condenses poorly. Therefore, such types of steam iron are superior to those just described that provide for the steam to exit not under the soleplate but along the side thereof. This steam exiting along the side of the soleplate will be referred to as surface steam in the following because it propagates on the surface of the material being ironed, covering those areas of the material over which the steam iron does not pass at this particular moment. In known steam irons operating with surface steam, however, the major part of the steam escapes upwardly, moistening the operator's hand and face because the discharge orifice and/or the steam pressure are inconveniently selected. The surface steam strikes a portion of the material which, as a rule, is not ironed over and heated as yet. This enables a substantially more effective condensation of the surface steam on the material being ironed, so that when the prior steamed material is ironed over subsequently, the smoothing effect obtained is improved compared to conventional steam ironing.

From SU 1201376 A a steam iron is known which is supplied with steam from an external steam generator through a hose pipe and which has a second line for the supply of current to the heating element for heating the soleplate. Typically, such ironing systems are used as professional irons, the external steam generator typically producing a steam pressure of about 200 kPa which corresponds to a steam pressure about 1,000 times greater than a steam pressure in conventional domestic irons with integral water tank and drip valve. The soleplate of this steam iron has a groove extending essentially parallel to the outer contour of the soleplate and, immediately adjacent thereto, along all sides of the iron, as a result of which the steam escapes forwardly ahead of the ironing nose, rearwardly to the end remote from the nose, and towards either side. The steam is directed through the steam conduit into a feed channel whose direction of flow is nearly perpendicular to the material being ironed, terminating in the circumferential groove. From the groove the steam passes through a very thin slot between the material being ironed and the slightly raised outer periphery of the soleplate. Considering that the slightly raised outer periphery of the soleplate is approximately semi-circular in cross section on the side facing the material being ironed, the steam flow first experiences great acceleration at the narrowest point between the soleplate and the material being ironed as a result of the Venturi effect, subsequently escaping, due to the outer radius, to any angular direction including upwardly away from the side of the material being ironed.

Disadvantageously, however, it may happen that such a narrow slot is blocked by very thick fabric or a very soft material being ironed so that steam is prevented from striking the surface. Moreover, the soleplate's outer contour edge which is radiused in cross section, while exhibiting relatively favorable properties as regards the mechanical smoothing of creases, has very poor properties as regards the distribution of steam after exiting the slot. The steam is discharged in like manner in all directions including upwardly, so that all of the ambient air up to a height of at least 50 cm from the material being ironed is equally exposed to substantial amounts of steam. This is not only uncomfortable for the operator but also causes a severely increased water consumption necessitating a very large external water reservoir. Adding to inefficiency is the very large area covered by the pre-steaming of the material being ironed due to the extremely high steam pressure.

A substantially more compact steam iron intended for normal household use is known from DE-OS 4133295 A1. In this iron, a water tank is integrated into the iron, and a heating element heats both the soleplate and a first and a second evaporation chamber. By means of a drip valve a uniform supply of water is fed from the water tank into the first evaporation chamber, as a result of which the steam is discharged, essentially by the action of atmospheric pressure and the force of gravity, out of steam discharge ports under the steam iron at a steam pressure of 100 to 200 Pa, approximately. Further, by means of a control button a piston pump may be operated, drawing water from the water tank and injecting it into the second evaporation chamber so that this steam, due to the pump pressure, is discharged at a somewhat higher pressure from an orifice that is arranged at a height of about 1.3 cm above the ironing surface and adjacent to the nose of the iron. This burst of surface steam generated by a piston pump is usually referred to as "jet function". While this "jet function" has proven to be eminently suitable for smoothing the wrinkles out of those areas where access is particularly difficult, particularly with the soleplate out of contact with the fabric, a continuous surface steam function is only possible with the pump in continuous operation. Moreover, only an area around the nose of the iron is exposed to steam, turbulences preventing the steam from dispersing close to the surface.

From U.S. Pat. No. 3,722,117 a steam iron of the type initially referred to is known, which includes a heating element for heating both the soleplate and a steam chamber, and a drip valve metering water from the water tank integrated into the iron into the steam chamber. A second steam discharge port is provided in the soleplate for the conventional discharge of steam beneath the steam iron, and a first steam discharge port is provided above the soleplate adjacent to the nose of the iron. Through a valve control, communication is established either between the steam chamber and the second steam discharge port for steam beneath the iron, or between the steam chamber and the first steam discharge port for surface steam. In this known embodiment, accordingly, only one of the two steam functions, that is, either surface steam or steam beneath the iron, can be selected at a time. It is a further disadvantage of this embodiment that the valve mechanism requires the steam to travel along a very narrow tortuous path in the steam conduit until it reaches the first steam discharge port, so that the steam propagates only in an area immediately ahead of the nose of the iron. In this event, steam from the first steam discharge port strikes fabric that is only a few centimeters ahead of the iron's nose and is already in preheated condition by heat radiation emitted from the soleplate, so that the steam's condensation properties on the material being ironed are not optimal. This effect is further aggravated when a swift ironing motion is used, accompanied by a still further reduced steam propagation. Moreover, the narrow steam path and the valve mechanism to the first steam discharge port are prone to become clogged with mineral deposits accumulating gradually. Finally, similar to DE-OS 4133295, in this known embodiment the first steam discharge port is arranged above the soleplate and solely at the nose of the iron so that a large quantity of steam condenses also on the housing of the iron itself and an appreciable portion of the aggregate of steam exiting from the first steam discharge port hovers uselessly as a high steam cloud in front of the iron, condensing in the air, and the risk for an operator's hands being scalded becomes greater still.

A further problem common to all know steam irons described in the foregoing is that the steam pressure residing at the discharge ports under the soleplate is materially diminished, because many kinds of fabric to be ironed are so dense that steam cannot pass therethrough, or because the supporting ironing board is insufficiently permeable to steam. This reduces the flow of steam substantially, diminishing the otherwise positive effects of steam ironing. The situation is similar in cases where a very thin fabric is ironed over with the conventional steam discharge ports under the soleplate, because then the major part of the steam passes through the material being ironed with little effect, exiting uselessly under an ironing board of good permeability. The same phenomenon can be observed in steam irons which include boilers integral with the iron or arranged externally on the steam ironing station and in which the major part of the steam passes through the article being ironed without much effect because of the high steam pressure applied.

It is therefore an object of the present invention to provide a steam iron of the type initially referred to without a boiler arrangement for steam generation, which uses the steam available from the evaporation chamber for application to the material being ironed as efficiently and as completely as possible, and which on the whole enables the smoothing action on the material being ironed to be enhanced.

This object is attained with a steam iron incorporating the features of claim 1, and with a steam iron incorporating the features of claim 2.

Advantageously, the first and the second steam discharge port are formed in the soleplate so that steam propagates in very close proximity to the surface, because state-of-the-art soleplates typically have a height of less than 10 mm and hence the first steam discharge port arranged in the soleplate for the surface steam is at a height of less than 10 mm relative to the material being ironed or the ironing surface of the soleplate, preferably at a height of less than 5 mm relative to the ironing surface in the ironing position. A further effect of the arrangement of the first and second steam discharge port in the soleplate is that the soleplate is sufficiently hot automatically, so that condensation droplets are prevented from forming at the discharge orifice, without the need to provide additional parts which are in thermally conducting connection to the sole. In addition, the first and the second steam discharge port are in balanced pressure communication with each other, so should one of the two steam discharge ports or groups of steam discharge ports be obstructed by dense fabric or should at least the steam pressure residing at these ports be diminished, a correspondingly greater amount of steam will exit the other steam discharge port in a self-regulating manner. This case may occur when a pleat in the material being ironed rests against the edge of the soleplate, nearly blocking the first steam discharge port situated on the side to deliver surface steam, or when the material being ironed is a dense fabric throughout, so that a second steam discharge port issues a lower amount of steam when the second steam discharge port is arranged under the steam iron on the soleplate. While according to the present invention in the first case the continuous and undiminishedly efficient surface steam function is maintained, in the second case where the first steam discharge port is provided to deliver surface steam and the second steam discharge port is provided to deliver steam under the iron, either both steam discharge ports are usable simultaneously and continuously, or at least the steam generated in the evaporation chamber is usable to its full amount and with optimum distribution regardless of the material being ironed.

Advantageously, the first and the second steam discharge port are in communication with each other independently of the material being ironed. Thus the balanced pressure connecting line or connecting groove between the first and the second steam discharge port is dimensioned and configured such that even in the presence of a very soft fabric causing the steam iron to press deep into the material being ironed, a balanced pressure steam communication between the first and the second steam discharge port is nevertheless ensured. Moreover, the steam connection is pressure balanced because preferably no valve is inserted.

With a first steam discharge port arranged such that the steam exits solely adjacent to the iron's nose and adjacent to the sides contiguous with the nose, a substantially larger steaming area for surface steam is made available also alongside the steam iron than with the orifices according to DE 4 133 295 and U.S. Pat. No. 3,722,117. On the other hand, the omission of surface steam discharge ports at the end remote from the iron's nose, that is, the heel rest on which the steam iron is conventionally stood, has the effect that the fabric is first solely steamed in the direction of movement towards the nose of the iron and is subsequently solely dried with the rear area of the iron's soleplate. According to the present invention, there is thus provided a steaming area for surface steam which is sufficiently large to pretreat with steam completely all the areas to be ironed over in the direction of movement.

In an advantageous embodiment according to claim 3, the second steam discharge port is arranged within the substantially plane ironing surface, the steam thus exiting through the second steam discharge port under the steam iron, dampening the article under the steam iron. Accordingly, the operations of conventional steaming under the steam iron and surface steaming through the first steam discharge port adjacent to the steam iron are possible simultaneously and continuously, producing a significantly improved smoothing result already after a single pass. The surface steam exiting through the first steam discharge port in extremely close proximity to the fabric surface operates to precondition the fabric which is subsequently smoothed conventionally by being ironed over. This increases the operator's independence on the article's degree of dryness still further, which in a conventional steam iron without surface steam or with inefficient surface steam could be compensated for only inadequately by constant actuation of the piston pump for the water spray, with the attendant disadvantage that the water spray tends to excessively moisten the material being ironed.

In another advantageous aspect, the first steam discharge port and/or the second steam discharge port are in uninterrupted communication with the evaporation chamber. This makes it possible to maintain the nominal steam flow rates under any ironing conditions occurring in practice.

In a further advantageous embodiment, the first steam discharge port is in communication with the second steam discharge port through a groove on the ironing surface, said groove opening into the first steam discharge port. Particularly where soleplates of easily formable aluminum material are utilized, the provision of a balanced pressure groove between the first and the second steam discharge port in the soleplate affords great ease of manufacture, that is, without necessitating any changes to the dies for the overlying cast aluminum body with its heating element. Moreover, it is not possible for a groove in the soleplate to be blocked, or at least not completely, by very soft ironing material, the groove thus ensuring an unobstructed passage of steam. Still further, the provision of a groove in the soleplate has the advantage that in one variant the groove constitutes merely the extension of the steam discharge port already disposed in a groove-type recess for steam under the steam iron. In a further embodiment represented here only briefly, the balanced pressure connection between the first and the second steam discharge port and/or the connection to the evaporation chamber are not formed in the ironing surface of the soleplate but in the overlying body in which the heating element is received. This arrangement ensures reliably that this steam connection cannot be interrupted by the material being ironed. This solution is of particular relevance to soleplates made of materials which are difficult to form as, for instance, high-quality steel, or to soleplates having a plane ironing surface with zero or minimum possible recesses or interruptions in the ironing surface or the planeness of the ironing surface.

In another advantageous embodiment, an imaginary center line between the first and the second steam discharge port through the groove forms an acute angle with an imaginary line of symmetry through the iron's nose and the center of the ironing surface, so that the steam exiting from the first steam discharge port is directed laterally forwardly when viewed in the direction of movement. Hence the orientation of the groove determines the direction of steam discharge for an area around the nose of the iron and around the forward half of the iron. In conjunction with a further first steam discharge port on the opposite edge side of the soleplate, the groove between the steam discharge ports has preferably the form of a V or W.

To accomplish a uniform distribution of steam under the iron, several second steam discharge ports are provided which are arranged in an essentially V-shaped configuration with the tip of the V pointing at the iron's nose, so that the iron can be moved and turned with ease.

In a further advantageous embodiment, the first steam discharge port is formed by a bevel provided on the edge of the ironing surface. Preferably, the bevel is at an angle of only between 2° and 10° to the material being ironed, so that the steam exiting from the first steam discharge port is directed in extremely close proximity to the surface. The provision of a plane bevel surface has the advantage over a rounded configuration that a defined, small exit angle of the steam from the first steam discharge port is accomplished, avoiding or permitting only small amounts of undesired steam components directed upwardly to the operator.

In a still further advantageous aspect, the bevel includes several slots or circular orifices for the discharge of steam from several first steam discharge ports. These orifices afford ease of manufacture and ensure a uniform distribution of surface steam in a forward area alongside and ahead of the steam iron. In cases where the groove provides for communication between the second steam discharge port and the first steam discharge port in the bevel, these orifices or slots are formed between the groove and the material being ironed or, in the absence of this groove, directly within the soleplate without the material being ironed contributing.

In another advantageous embodiment, the bevel extends to the iron's nose only such an amount that the plane ironing surface of the soleplate continues to be plane up to the nose and around the nose, with the first steam discharge port being arranged adjacent to this area. Thereby a slim pointed tip is maintained in spite of the adjacent bevel on the two adjoining sides of the soleplate's edge, which tip continues to be suitable for use in areas where access is particularly difficult as around buttons. Because the bevel extends close to the iron's nose, the presence of surface steam in a major area ahead of the iron's nose is also ensured.

By providing a first steam discharge port above the ironing surface and on the side of the soleplate, it is possible, on the one hand, for steam to exit in a very shallow way in very close proximity to the surface, while on the other hand the steam discharge port is formed by the soleplate itself, preventing condensation droplets from depositing around the first steam discharge port which practically eliminates the risk of a "blocked condition" of the first steam discharge port. In this embodiment, the balanced pressure connection is formed in a cavity between the inside of the soleplate and the overlying cast body with its heating element.

In another advantageous embodiment, provision is made for an additional soleplate demountable from and attachable to the soleplate fixedly connected with the steam iron, in which additional soleplate there are either only first steam discharge ports, enabling a conventional steam iron to be selectively used for producing solely surface steam by attachment of the additional soleplate, or for producing surface steam as an addition. With steam discharge ports used solely for surface steam, a balanced pressure arrangement is advantageous particularly when the discharge of steam through one of the steam discharge ports is blocked by contact with a thickening in the material being ironed, the nominal steam flow rates then being maintainable unchanged.

In a further advantageous embodiment, the first steam discharge port(s) is (are) arranged to extend from the nose of the iron to either side in an edge area of the soleplate, extending however towards the center and to the rear portion relative to the preferred ironing direction of the nose only such an amount that dampening or steaming of the material being ironed is effected through the forward portion of the steam iron, while the rear portion of the steam iron performs solely a drying function.

Advantageous embodiments of the present invention are represented in the subclaims.

Further features, advantages and application possibilities of the present invention will become apparent from the subsequent description of several embodiments illustrated in more detail in the accompanying drawings. It will be understood that any single feature and any combination of single features described and/or represented by illustration form the subject-matter of the present invention, irrespective of their summary in the claims or their back-reference.

In the drawings,

FIG. 8 is a bottom plan view of the ironing surface of a soleplate according to an eighth embodiment of the present invention, indicating dimensions by way of example;

Figure 9A:
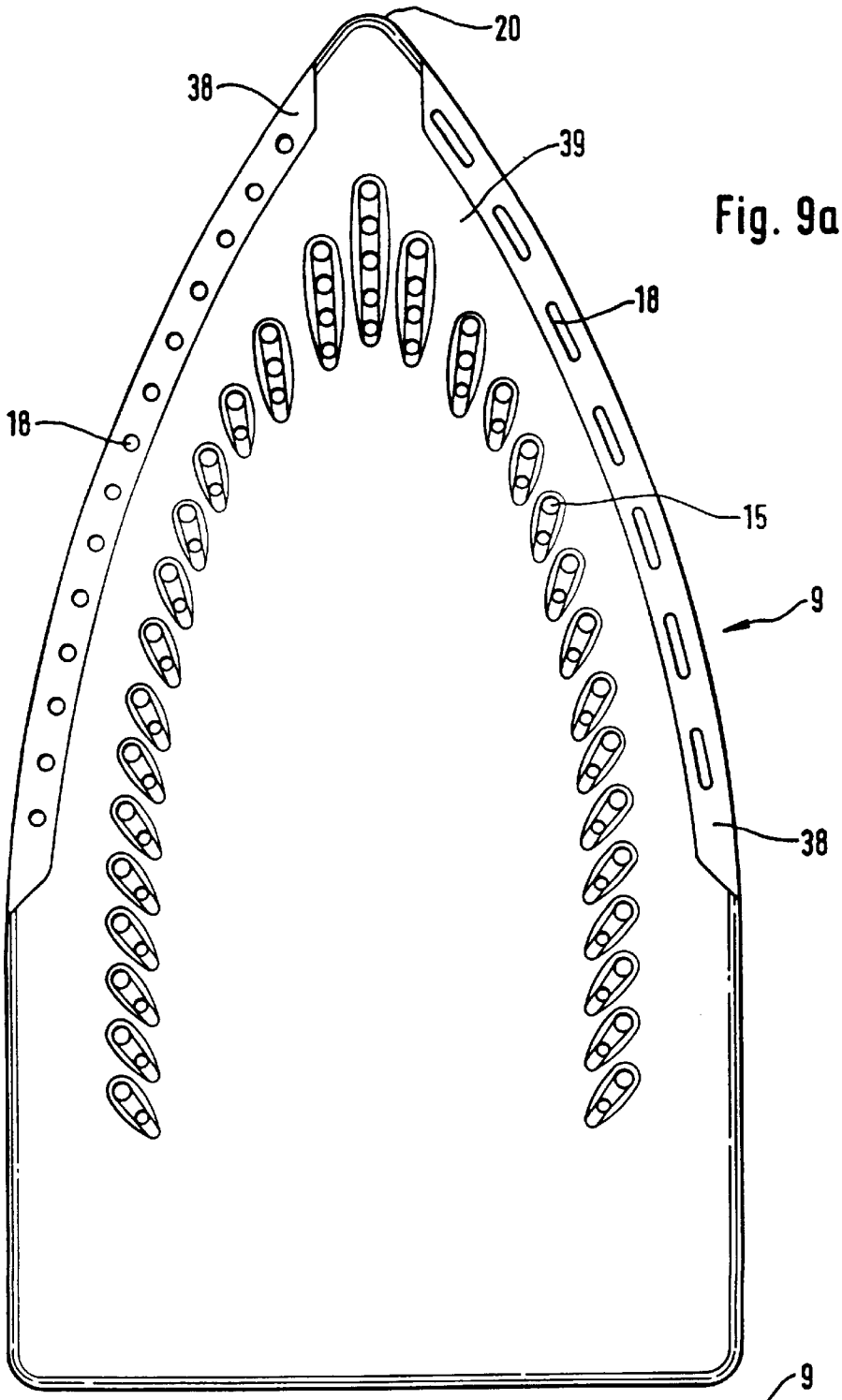
Figure 9B:
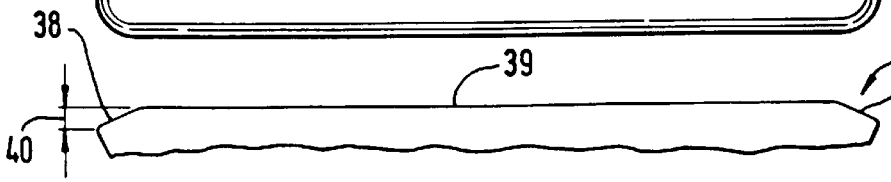

FIG. 8*a* is a sectional view of the soleplate taken along the line 8*a*—8*a* of FIG. 8;

FIG. 8*b* is a sectional view of the soleplate taken along the line 8*b*—8*b* of FIG. 8;

FIG. 9*a* is a bottom plan view of the ironing surface of a soleplate according to a ninth embodiment of the present invention;

FIG. 9*b* is a front elevation of the soleplate of FIG. 9*a;*

Figure 10A:
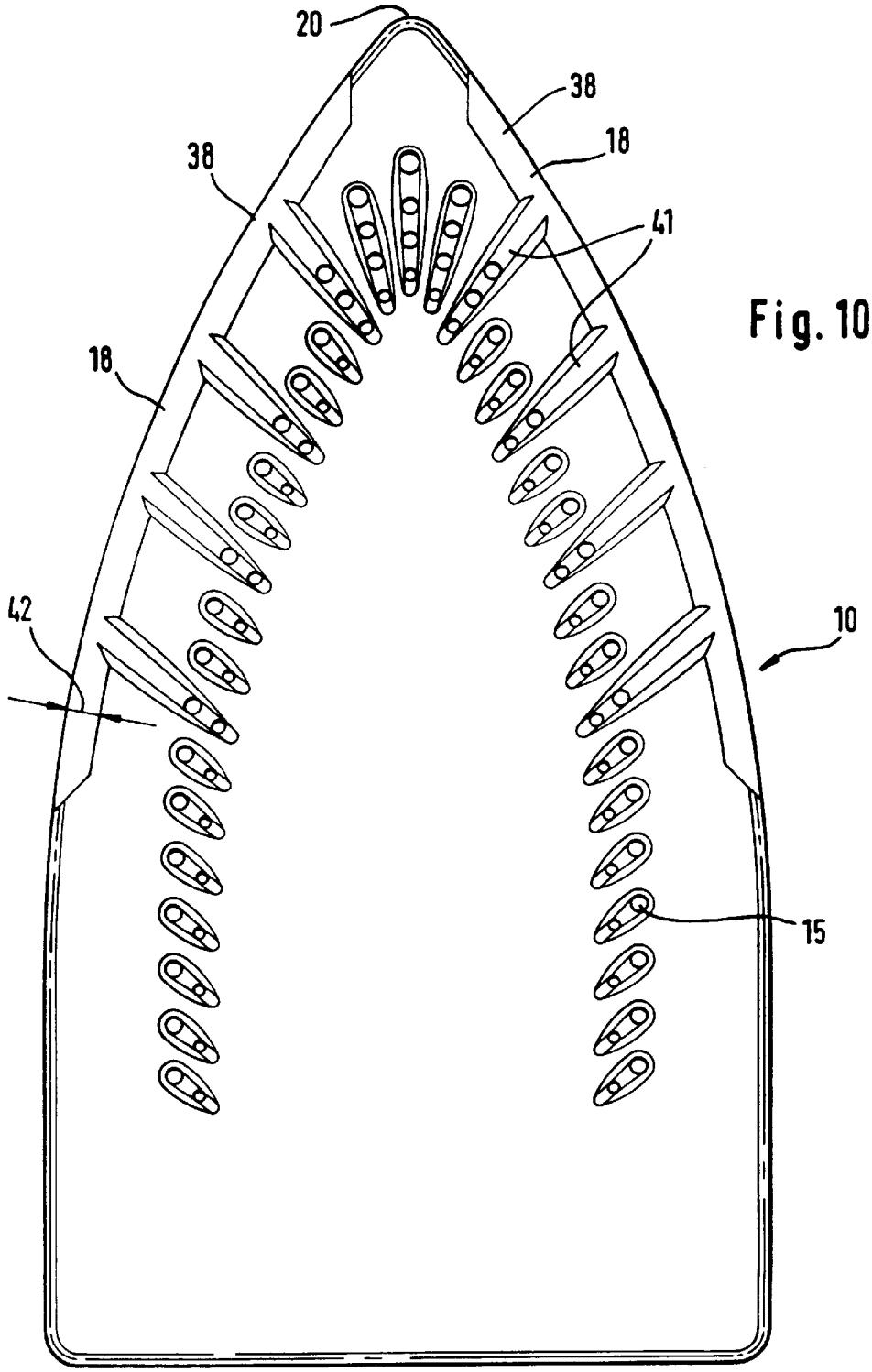
Figure 10B:
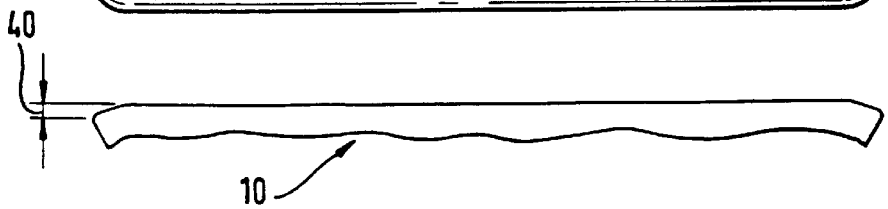

FIG. 10*a* is a bottom plan view of the ironing surface of a soleplate according to a tenth embodiment of the present invention;

FIG. 10*b* is a front elevation of the soleplate of FIG. 10*a;*

Figure 11B:
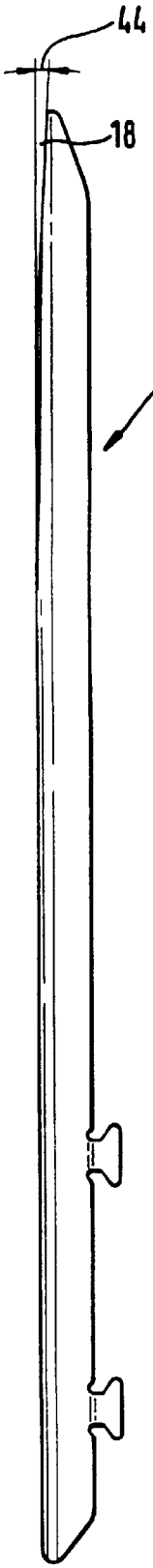
Figure 11A:
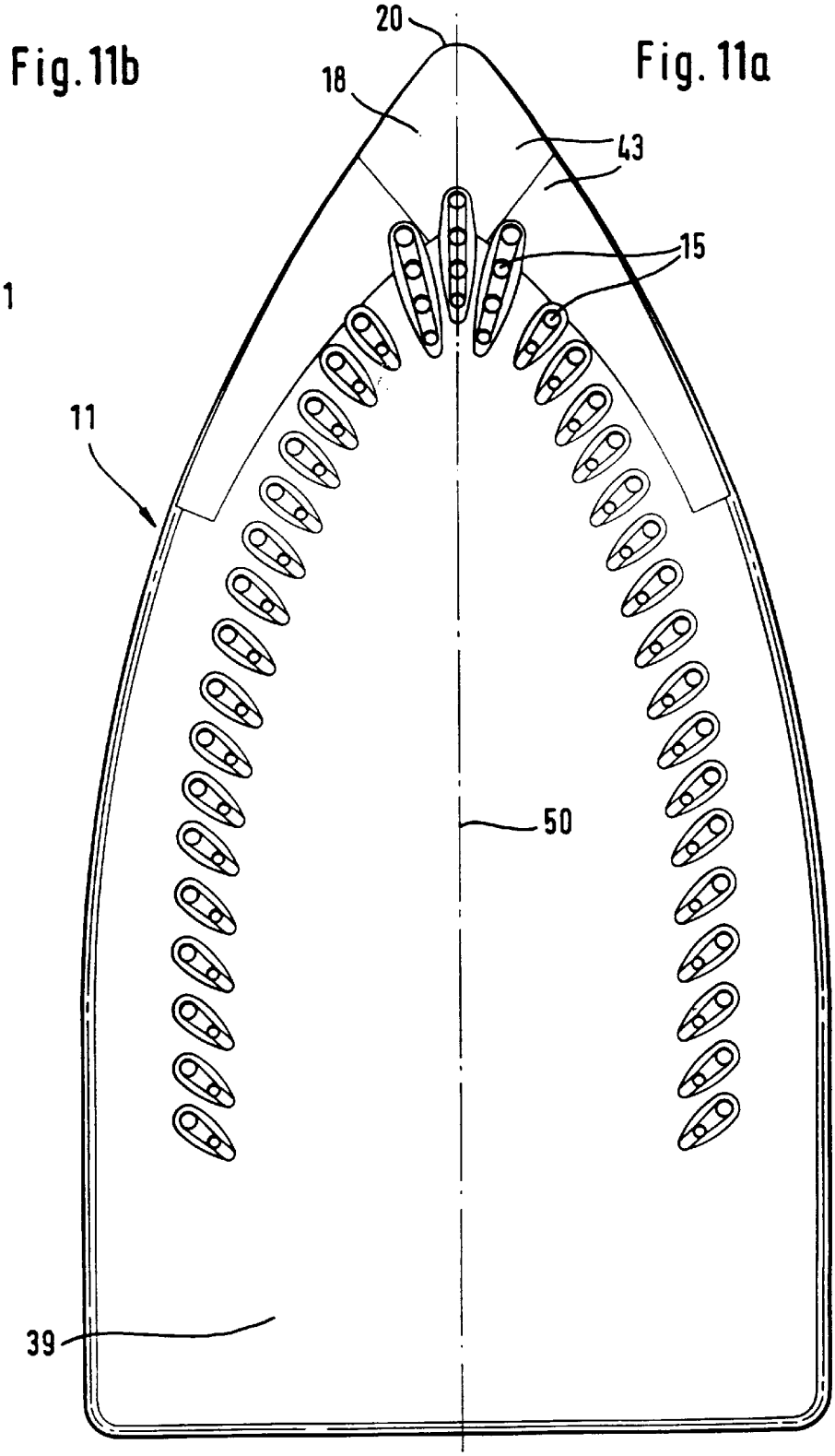

FIG. 11*a* is a bottom plan view of the ironing surface of a soleplate according to an eleventh embodiment of the present invention;

FIG. 11*b* is a side view of the soleplate of FIG. 11*a;*

Figure 12B:
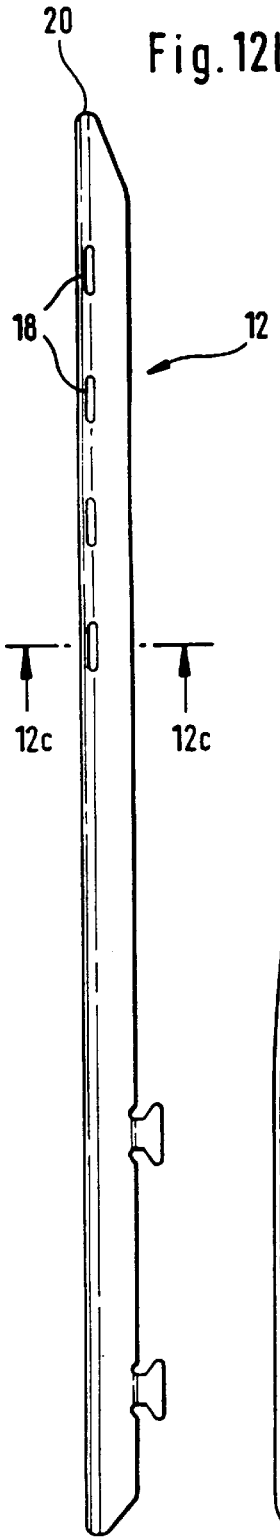
Figure 12A:
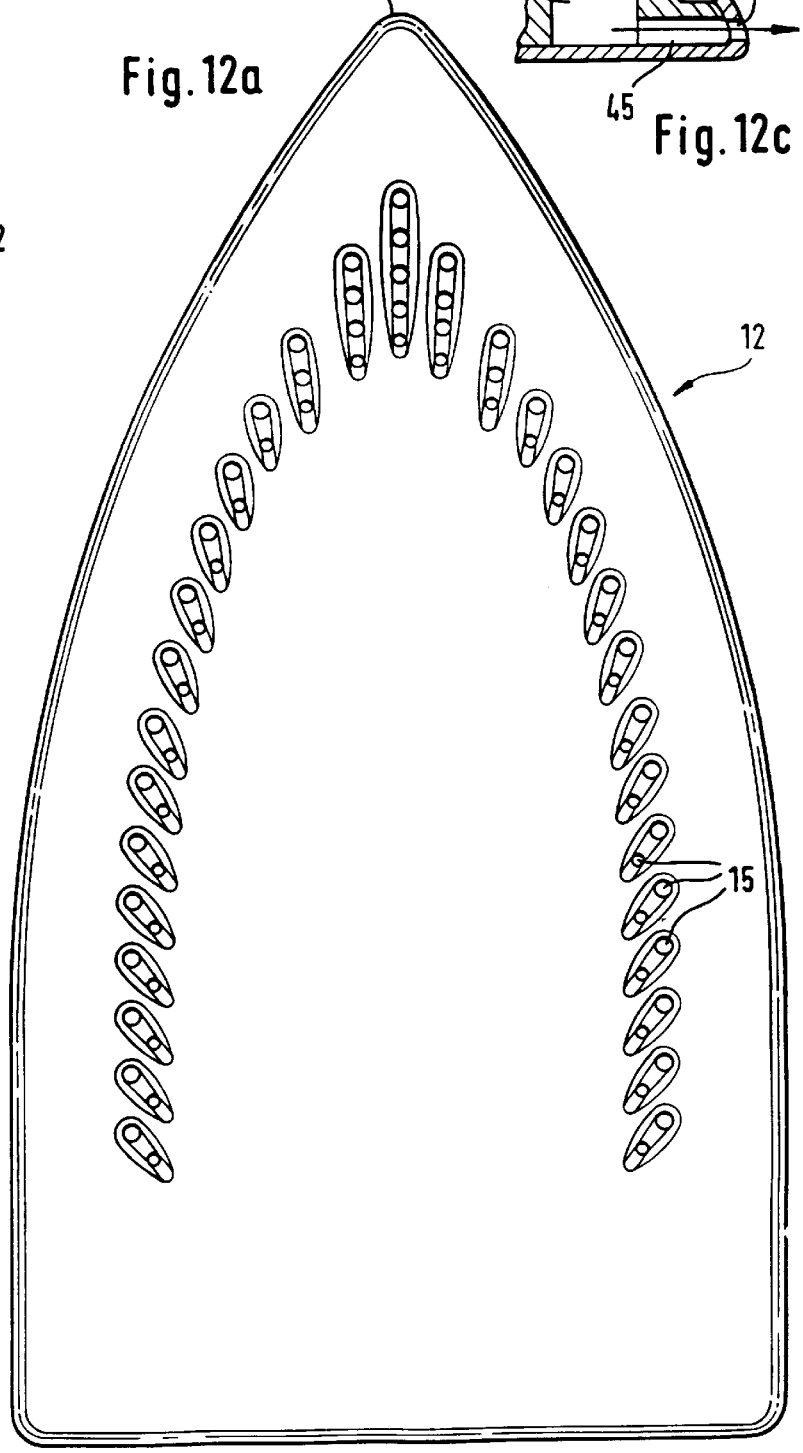

FIG. 12*a* is a bottom plan view of the ironing surface of a soleplate according to a twelfth embodiment of the present invention;

FIG. 12*b* is a side view of the soleplate particularly of FIG. 12*a;*

Figure 12C:
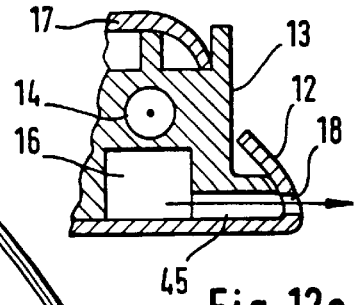

FIG. 12*c* is a schematic sectional view of the soleplate and the adjoining edge area of the iron, taken along the line 12*c*—12*c* particularly of FIG. 12*b;*

Figure 13:
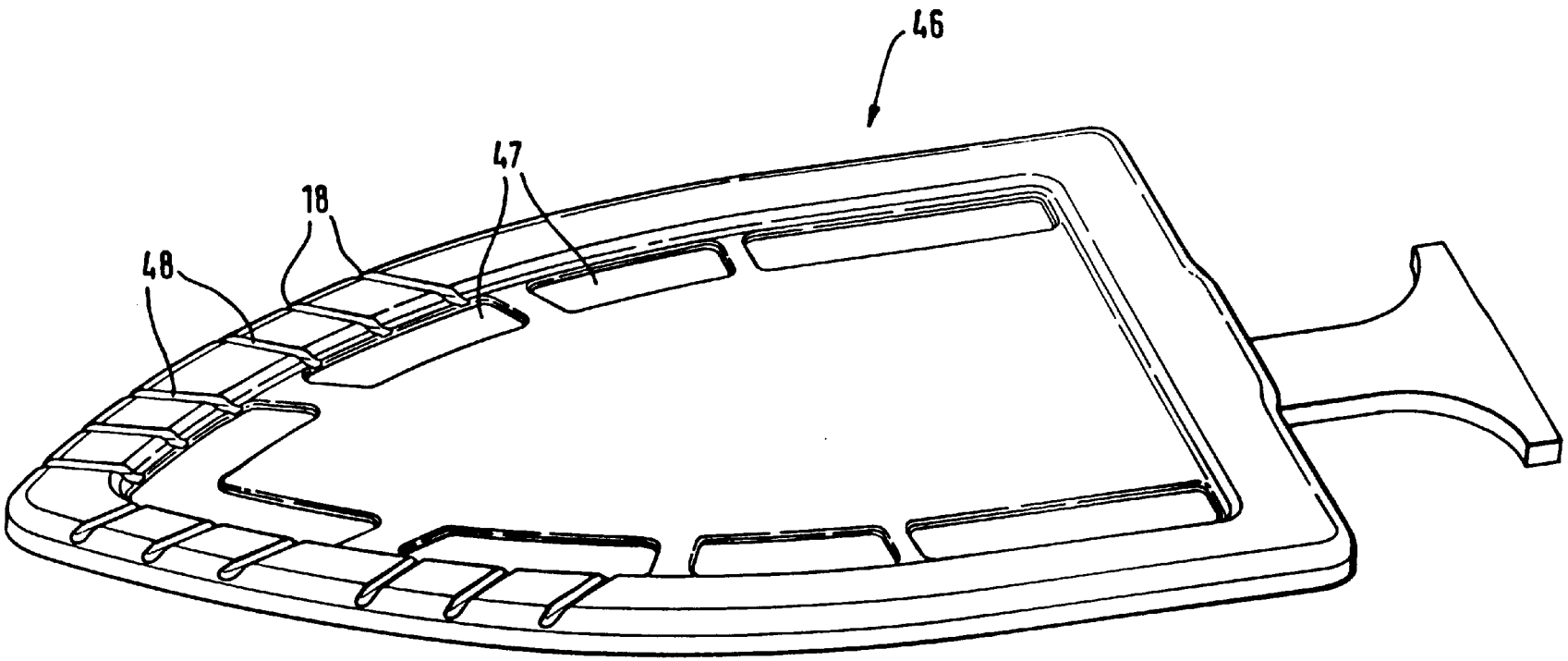
Figure 14:
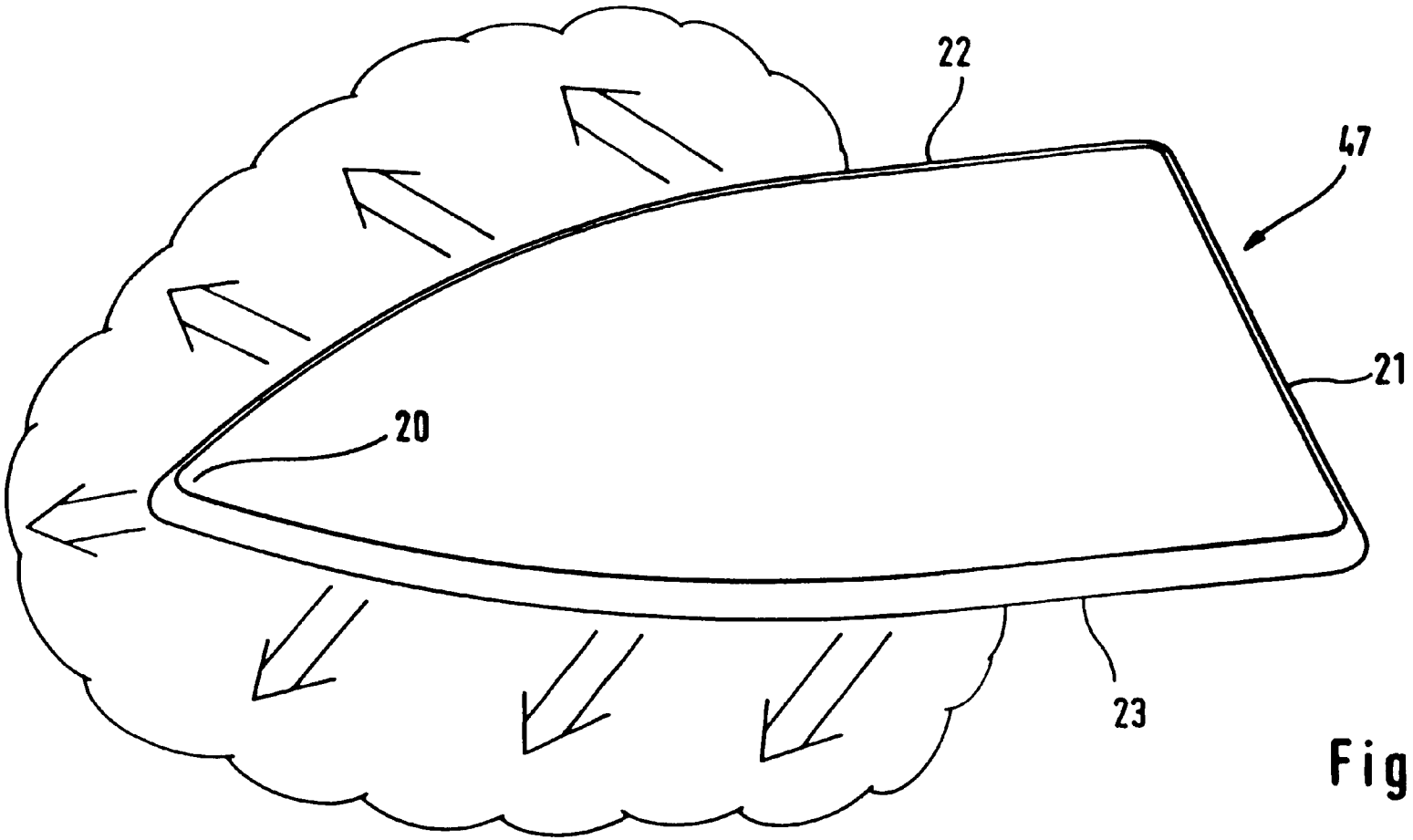

FIG. 13 is a perspective view of an attachable soleplate of the present invention; and FIG. 14 is a schematic illustration of the propagation of surface steam using a soleplate according to FIGS. 1 to 13.

The soleplates illustrated in the Figures are component parts of a smoothing iron for domestic use which is essentially constructed as described in the following.

The steam iron comprises a housing on which a handle and a variety of control buttons for temperature selection, steam level, water spray and, depending on the iron's features, various further (steam) function controls are provided. The steam iron features, for example, a "shot of steam" function delivering a powerful shot of steam between the soleplate and the material being ironed. Moreover, the steam iron is equipped with a "jet" function, for example, producing a powerful burst of steam far ahead of the iron's nose.

The steam iron also includes a water tank integrated or integrable into the housing and provided as a reservoir for the steam to be generated.

The steam iron further includes a component referred to as a shoe 13 (see FIG. 12*c*) to the undersurface of which the soleplate 1, 2, 3, 4, 5, 6, 7, 8, 9, 10, 11, 12 is affixed. The shoe 13 is a cast body of aluminum in which a heating resistor 14 operating as a heating element is embedded. The heating resistor 14 is arranged in the shoe 13 in a U-shaped configuration to conform to the arrangement of the second steam discharge ports 15. The shoe 13 includes preferably an evaporation chamber comprising a steam generating chamber and a steam distribution chamber 16 in steam communication therewith at all times. The steam generating chamber is arranged in a central area of the shoe 13 on the inside relative to the heating resistor 14 and is sealed upwards relative to the side remote from the soleplate by a steam chamber cover plate 17. Downwards on its side close to the soleplate, the steam distribution chamber 16 is open. Depending on the embodiment, the steam generated in the steam generating chamber is directed from the steam distribution chamber 16 to the first and/or second steam discharge ports 18, 15 in steam communication therewith.

The soleplate 1, 2, 3, 4, 5, 6, 7, 8, 9, 10, 11, 12 is an aluminum sheet part having its edge area bent—as shown in FIG. 12*c*—to form an acute angle and embrace the edge area of the shoe 13. In this arrangement the first steam discharge port 18 is provided in the soleplate. In the event of an alternative embodiment being selected in which the soleplate is plane throughout (not shown in the Figures) and in which also the edge area extends in a plane configuration without being bent, the first steam discharge port may also be provided above and on the soleplate, the thin material thickness of about 2 to 3 mm of such a soleplate enabling the steam to exit in still sufficiently close proximity to the surface.

First steam discharge port 18 is understood to mean an opening for the exit of steam from the soleplate 1, 2, 3, 4, 5, 6, 7, 8, 9, 10, 11, 12 or the shoe 13, which opening is arranged on the outer peripheral edge of the soleplate or the shoe, the hot steam being consequently directed from the evaporation chamber to exit adjacent to the soleplate, rather than under the soleplate. This steam is referred to as surface steam which propagates on the surface of the material being ironed in those areas that are not covered by the soleplate.

Second steam discharge port 15 is understood to mean an opening for the exit of steam from the soleplate 1, 2, 3, 4, 5, 6, 7, 8, 9, 10, 11, 12 or the shoe 13, which opening releases the hot steam under the soleplate, yet leaving out the area covered by the iron as it passes over the material being ironed. Only in the special case not shown in the Figures in which steam is not intended to exit under the iron, providing solely surface steam instead, is also the second steam discharge port arranged similar to the first port to form surface steam. In the following further description of the Figures, the second steam discharge port will not refer to the special case but to the normal case previously described.

Preferably, a plurality of first and second steam discharge ports 18, 15 are provided. In particular, more than two and, respectively, three, preferably more than 50 second and more than five first steam discharge ports 15 and 18, respectively, are formed in or adjacent to the soleplate.

FIGS. 1 to 8, 9*a*, 10*a*, 11*a* and 12*a* illustrate in a plan view that side of the soleplate that faces the article being ironed.

In FIGS. 1 to 8 and 9*a* to 12*a* the second steam discharge ports 15 are of like configuration and arranged in the soleplate 1, 2, 3, 4, 5, 6, 7, 8, 9, 10, 11, 12. By way of example for all these Figures, the second steam discharge port 15 will be described in the following with reference to FIG. 12*a*. This Figure shows an embodiment in which the second steam discharge ports 15 are of conventional configuration and independent of the first steam discharge ports 18. A total of 71 individual second steam discharge ports 15 are provided which in combination form an essentially U- or V-shaped pattern arranged directly beneath the conformably shaped steam distribution chamber 16. The U- or V-shape of all second steam discharge ports mates with the outer contour of the soleplate 12 so that the tip of the V is located adjacent to the nose of the iron. The second steam discharge ports 15 are configured as bores extending through the soleplate 12 and to the steam distribution chamber 16. Two or more second steam discharge ports 15 are invariably combined in a connecting groove which, viewed from above (see FIG. 12), has the shape of a drop oriented forwardly towards the iron's nose or forwardly towards the side.

In the embodiments of FIGS. 1 to 6, 8 and 10*b,* first steam discharge ports 18 for surface steam are obtained by elongating the drop-shaped grooves of the second steam discharge ports outwardly towards the side or outer contour of the soleplate, the mouth of such a groove 19, 24, 25, 26 on the outer contour combining with the material being ironed to form the first steam discharge port for surface steam. The groove 19, 24, 25, 26 thus provides for balanced pressure communication between the first and the second steam discharge port 18, 15. In all embodiments the first and the second steam discharge port are in continuous steam communication with the steam distribution chamber 16 and hence connected therewith in a pressure-compensating, that is, balanced pressure manner. For example, when such a steam iron rests on an article which due to the type of fabric and, where applicable, the ironing board used allows the passage of zero or only very little steam from the second steam discharge port 15, the nominal steam pressure generated in the evaporation chamber continues to be sufficient for steaming the article through the first steam discharge ports 18. The balanced pressure connection ensures steaming under any ironing condition. Conventionally, in steam irons of this type featuring a drip valve and instant flashing into steam of the water dripping into the steam generating chamber, atmospheric pressure and force of gravity combine to generate a steam pressure of 200 Pa, max. and a steam delivery rate of smaller than 16 g/min, approximately. A higher steam pressure is disadvantageous because it entails a significant increase in the steam delivered to the air and rising upwardly. Therefore it is important that the soleplates be used in combination with the domestic iron of the type initially referred to.

Figure 1:
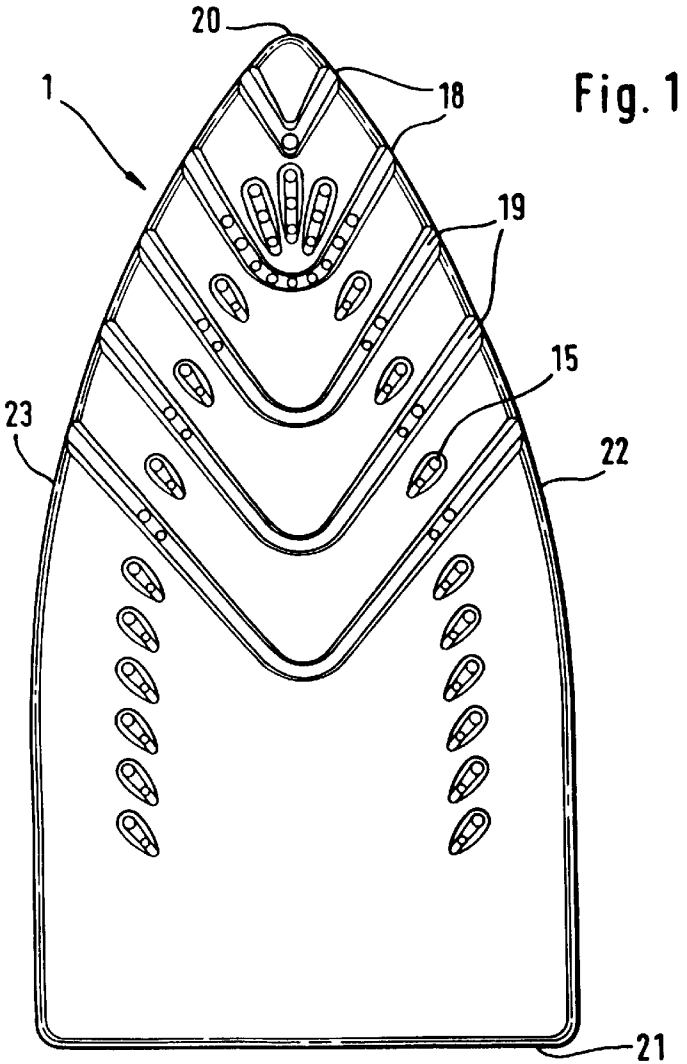
FIG. 1 is a bottom plan view of the ironing surface of a soleplate according to a first embodiment of the present invention.

Provided in the soleplate 1 of FIG. 1 are a total of five grooves 19 each extending in an approximately V-shaped configuration. The "tip" of the V is rounded, oriented in opposition to the (rounded) nose 20 of the soleplate and intersects the imaginary connecting line between the nose 20 and the rear end of the soleplate 1. This connecting line forms at the same time an axis of symmetry about which the steam discharge ports 18, 15 are arranged in mirror symmetry.

As seen looking in the direction of movement, the steam discharge ports 18 in the grooves 19 are disposed in a forward portion of the sides 22 and 23 contiguous with the nose 20 of the iron. The first steam discharge ports 18 extend up to about the forward half relative to the forward nose 20. The two legs of the V-shaped grooves 19 define between them an angle of between 60° and 110°, approximately, so that the steam arriving from these grooves flows and exits as surface steam in a laterally forward direction when viewed in the direction of movement. This is of importance because it is assumed that ironing invariably starts in an area around the iron's nose or on the side adjoining the nose, whereby these areas are preconditioned with surface steam before being ironed over by the soleplate 1. Because of similar considerations the first and the second steam discharge ports 18, 15 are arranged in a forward portion of the soleplate when viewed in the direction of movement, so that the rear soleplate portion in which no steam discharge ports are provided is able to perform solely and hence very efficiently a drying action on the steamed material. This mode of operation is alike for all embodiments illustrated in the Figures. With regard to the soleplates 1 to 10 and 12 it holds equally true that there is no first steam discharge port 18 directly in the foremost portion of the iron's nose 20, being instead set back a small amount on the side. This recessed arrangement of the first steam discharge port 18 backwards from the nose 20 as seen looking in the direction of movement ensures on the one hand that also the area directly ahead of the nose 20 is exposed to surface steam, while on the other hand the nose 20 can be utilized without the risk for the material being ironed catching on a first steam discharge port 18. In the embodiments of the soleplates 1, 2 and 3, an additional second steam discharge port 15 is provided in the V-shaped groove 19 lying closest to the iron's nose in order to supply steam to the area beneath the iron and surface steam. In the soleplates 1, 3 and 4, the foremost V-shaped groove 19 just described is followed by a further V-shaped groove with a markedly rounded "tip". Disposed between these two foremost V-shaped grooves 19 are three drop-shaped grooves with second steam discharge ports 15. The second V-shaped groove 19 as seen looking from the iron's nose, as well as all further grooves 19 remote from the nose 20 follow at equal relative distances, the grooves including each two times two second steam discharge ports 15 for the supply of steam to these V-shaped grooves. In the soleplate 1, the second V-shaped groove as seen looking from the iron's nose 20 includes the added provision of further second steam discharge ports 15—totaling nine—in the tip region of the V, causing a particular high quantity of surface steam to be available in a forward area of the soleplate around the iron's nose 20. In the soleplate 1, the further V-shaped grooves are arranged on every second drop-shaped groove for second steam discharge ports 15 up to a total of five V-shaped grooves 19 are provided in this embodiment.

Figure 4:
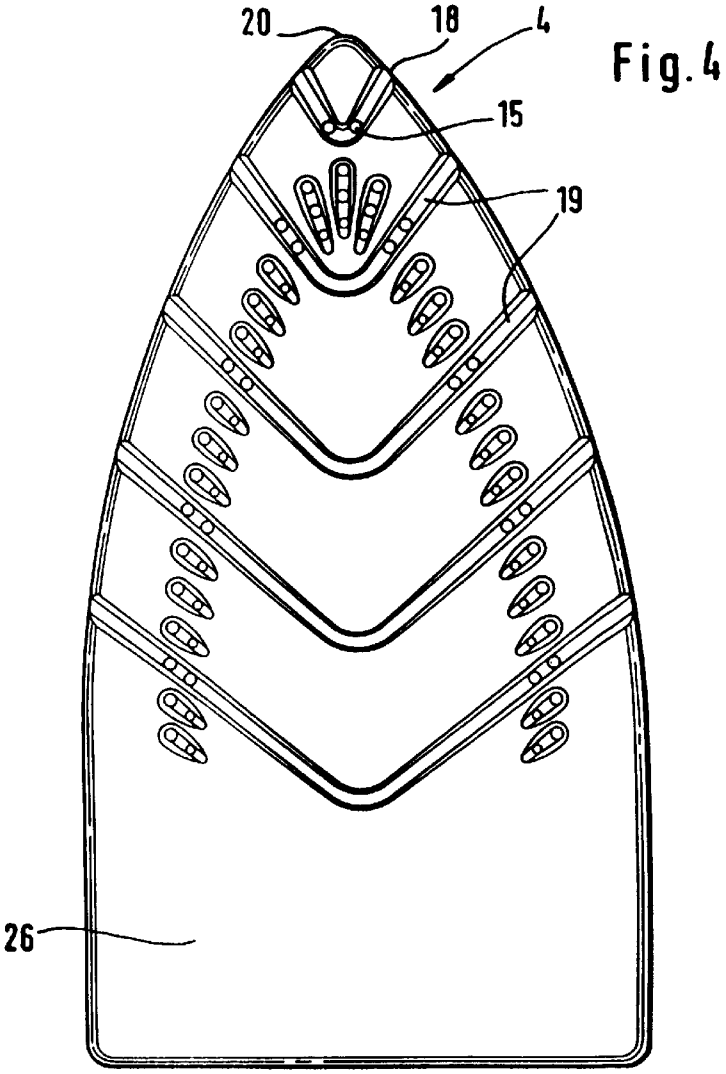
FIG. 4 is a bottom plan view of the ironing surface of a soleplate according to a fourth embodiment of the present invention.

In the soleplate of FIG. 4, the second V-shaped groove when viewed from the iron's nose 20 is succeeded by further rearward V-shaped grooves 19 each arranged on every fourth drop-shaped groove for second steam discharge ports 15. As a result, with the soleplate 4 the area for surface steam on the material being ironed is concentrated around the iron's nose 20 to a lesser degree than it is with the soleplate 1. The V-shaped grooves have the added advantage that a soleplate area performing a drying function invariably alternates with a soleplate area performing a dampening function with its groove 19.

Figure 2:
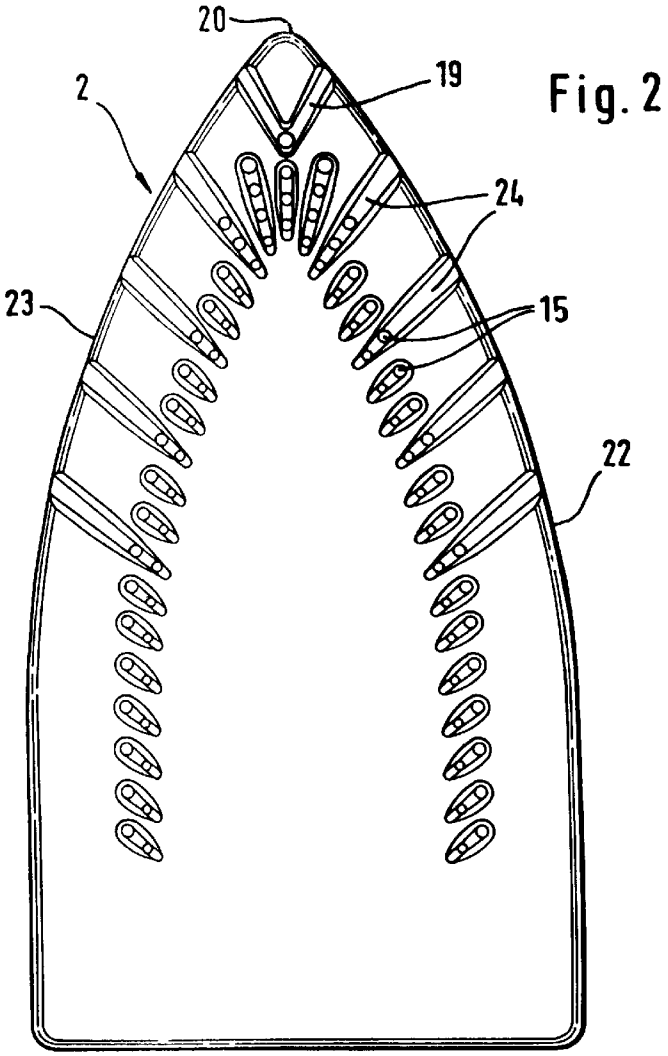
FIG. 2 is a bottom plan view of the ironing surface of a soleplate according to a second embodiment of the present invention.

In the soleplate 2 of FIG. 2, apart from a V-shaped groove 19 arranged in the immediate vicinity of the iron's nose 20, further grooves 24 are pressed into the soleplate as an extension of second steam discharge ports 15. In this embodiment, the drop-shaped grooves are extended only in outward direction towards the outer contour 22, 23 of the soleplate. After the three foremost drop-shaped grooves for second steam discharge ports 15 located closest to the iron's nose 20, there follows on either side (again in mirror symmetry) of the longitudinal axis of symmetry 50 a groove 24 which subsequently forms an extension of every third drop-shaped groove for second steam discharge ports 15 until a total of four such grooves 24 are formed on either side adjacent to the iron's nose. It will thus be seen that in the soleplate 2 the entire inner surface area of the soleplate is devoid of steam discharge ports or grooves and thus capable of operating as a pure drying zone.

Figure 3:
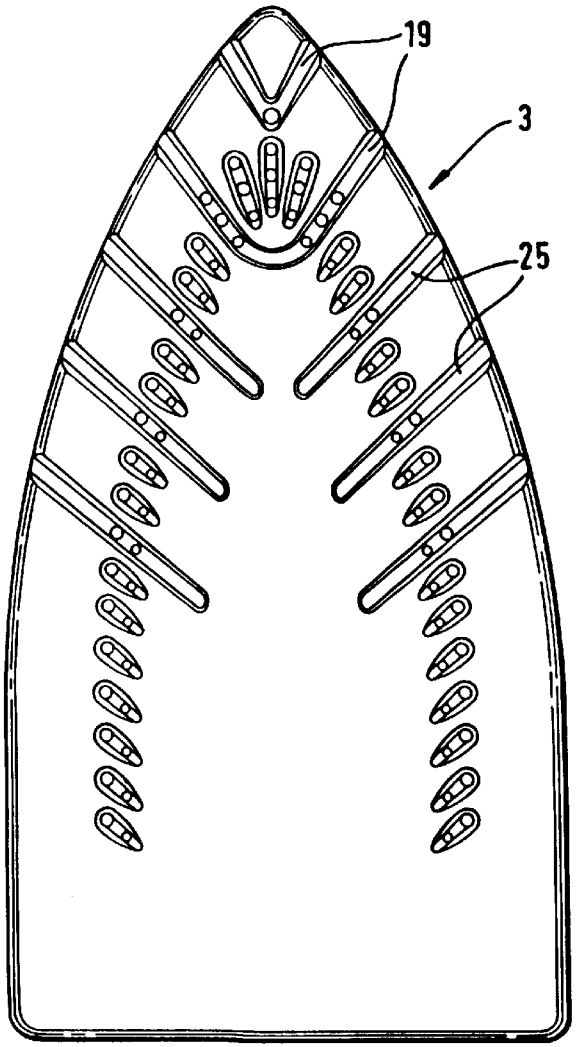
FIG. 3 is a bottom plan view of the ironing surface of a soleplate according to a third embodiment of the present invention.

The soleplate 3 of FIG. 3 differs essentially from the soleplate 2 only in the arrangement of two forward V-shaped grooves 19 followed in the direction away from the iron's nose 20 by three grooves 25 on either side which not only form an extension of the drop-shaped grooves of the second steam discharge ports 15 towards the outer contour 22, 23 of the soleplate 3, but also extend inwardly towards the above-mentioned imaginary line of symmetry or connecting line 50, without however two opposed grooves 25 which lie level with each other converging centrally to form a V. With regard to its effect, this soleplate represents a compromise between the soleplates 2 and 4.

The soleplate 4 is configured such as to make provision for an increased final drying surface 51 adjacent to the rear outer contour edge 21 of the soleplate 4 at the end remote from the iron's nose. Moreover, the V-shaped groove 19 in the immediate vicinity of the iron's nose 20 has two second steam discharge ports 15, as a result of which an increased amount of surface steam is available in the area immediately around the nose.

Figure 5:
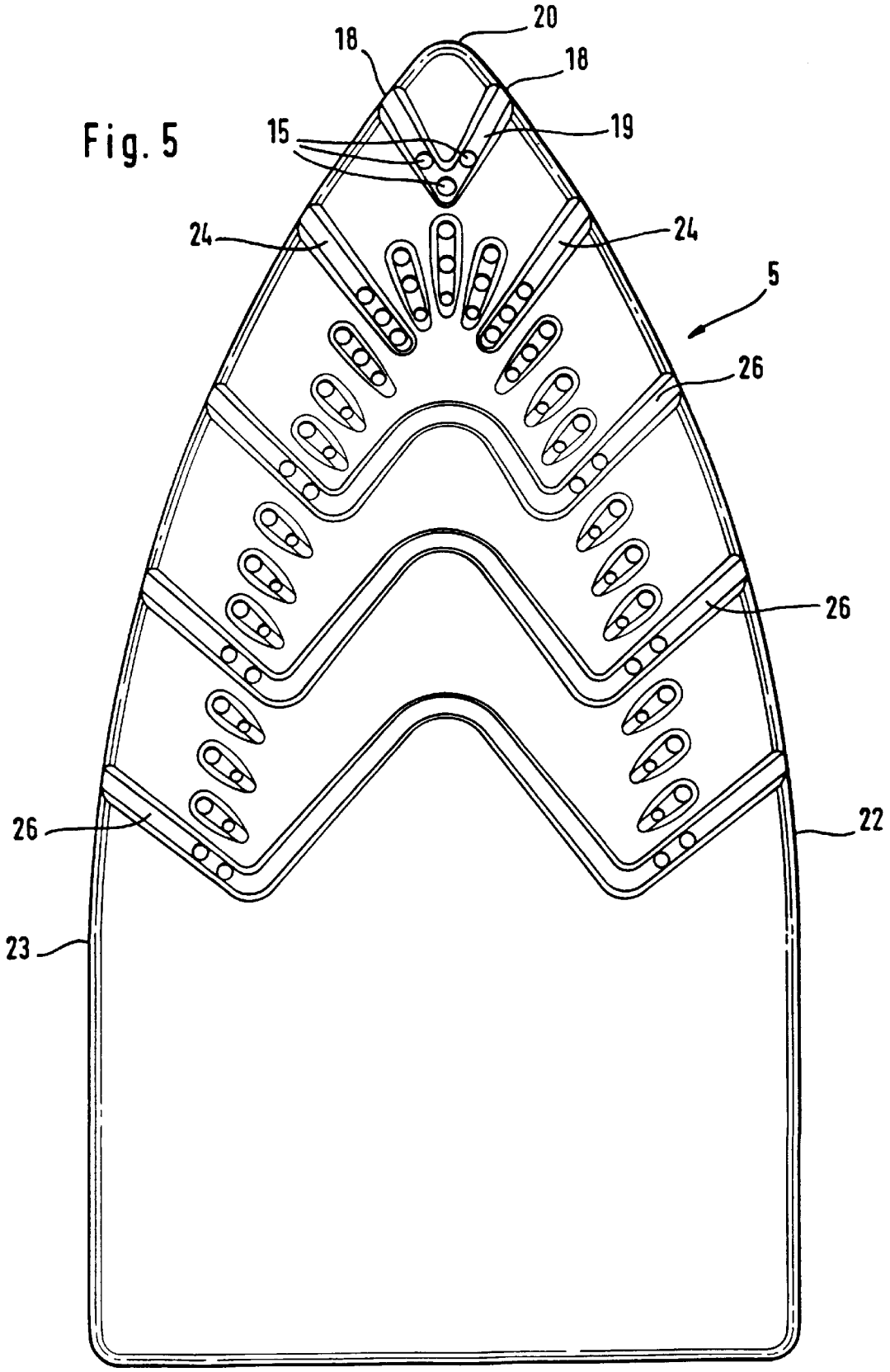
FIG. 5 is a bottom plan view of the ironing surface of a soleplate according to a fifth embodiment of the present invention.

The soleplate 5 of FIG. 5 has immediately adjacent to the iron's nose 20 a first V-shaped groove 19 supplying steam through three second steam discharge ports 15, including surface steam through the first steam discharge ports. On the side remote from the nose 20 follow grooves 24 which extend the drop-shaped groove only outwardly, as set forth in the foregoing with reference to the soleplate 2. Finally, there are provided on every fourth drop-shaped groove with its second steam discharge ports 15 a total of three grooves 26 which extend in a W-shaped configuration. Similar to the grooves 19, 24 and 25, the W-shaped grooves 26 guide the steam flow for surface steam outwardly outside the soleplate, laterally forwardly around the iron's nose, and in a forward area along the sides 22 and 23 adjoining the iron's nose. In contrast to the aforementioned grooves 19, 24, 25, the W-shaped grooves 26 have their inner portion with the rounded tip pointing in the direction of the iron's nose 20, causing wet and dry intervals to alternate on the soleplate similar to the V-shaped grooves, yet with the result of enhancing the maneuverability on the material being ironed still further.

Figure 6:
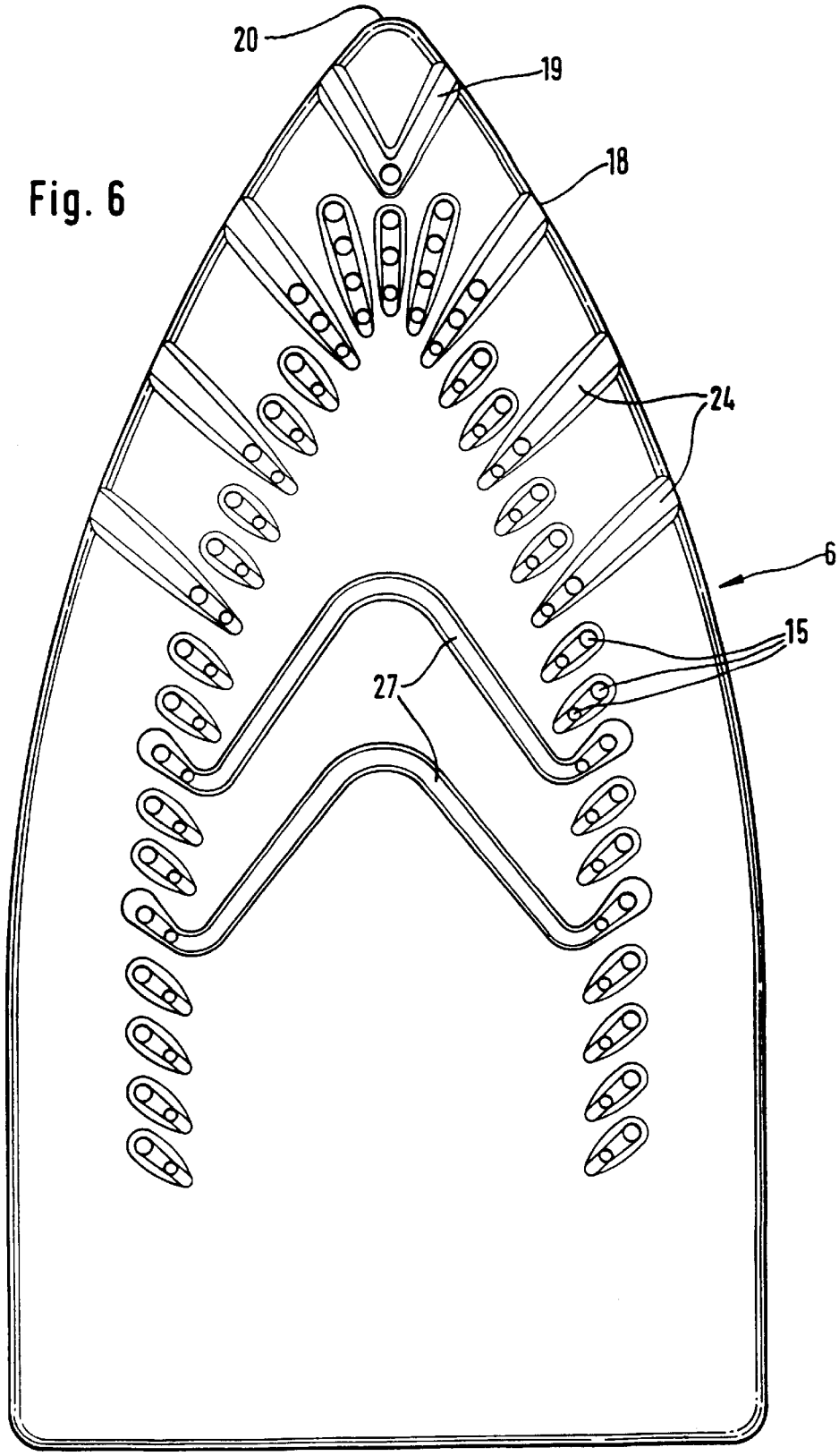
FIG. 6 is a bottom plan view of the ironing surface of a soleplate according to a sixth embodiment of the present invention.

The soleplate 6 of FIG. 6 includes similar to the soleplate 2 a V-shaped groove 19 for surface steam in an area adjacent to the iron's nose 20, followed by three adjacent grooves 24 on either side similar to the soleplate 2, which as in the soleplate 2 are arranged on every third drop-shaped groove for the second steam discharge port, extending these only outwardly towards the outer contour of the soleplate. Then follow, again in spaced relation on every third drop-shaped groove for a second steam discharge port 15, two connecting grooves 27 which are arranged in the middle area bounded by the U- or V-shape of the second steam discharge ports 15 relative to both the longitudinal and transverse direction of the soleplate. Similar to the W-shaped grooves 26 of the soleplate 5, the connecting grooves 27 are configured such that between two opposite drop-shaped grooves for second steam discharge ports 15 the connecting groove has approximately the shape of a V whose rounded "tip" points in the direction of the nose 20. However, in contrast to the W-shaped groove 26 of the soleplate 5, the connecting groove 27 is not extended outwardly towards the outer contour for the supply of surface steam. Hence the connecting grooves 27 serve to enhance the dampening function on the material underneath the soleplate during ironing, affording at the same time the same advantages as with the soleplate 5, that is, good maneuverability of the soleplate on the material being ironed.

Figure 7:
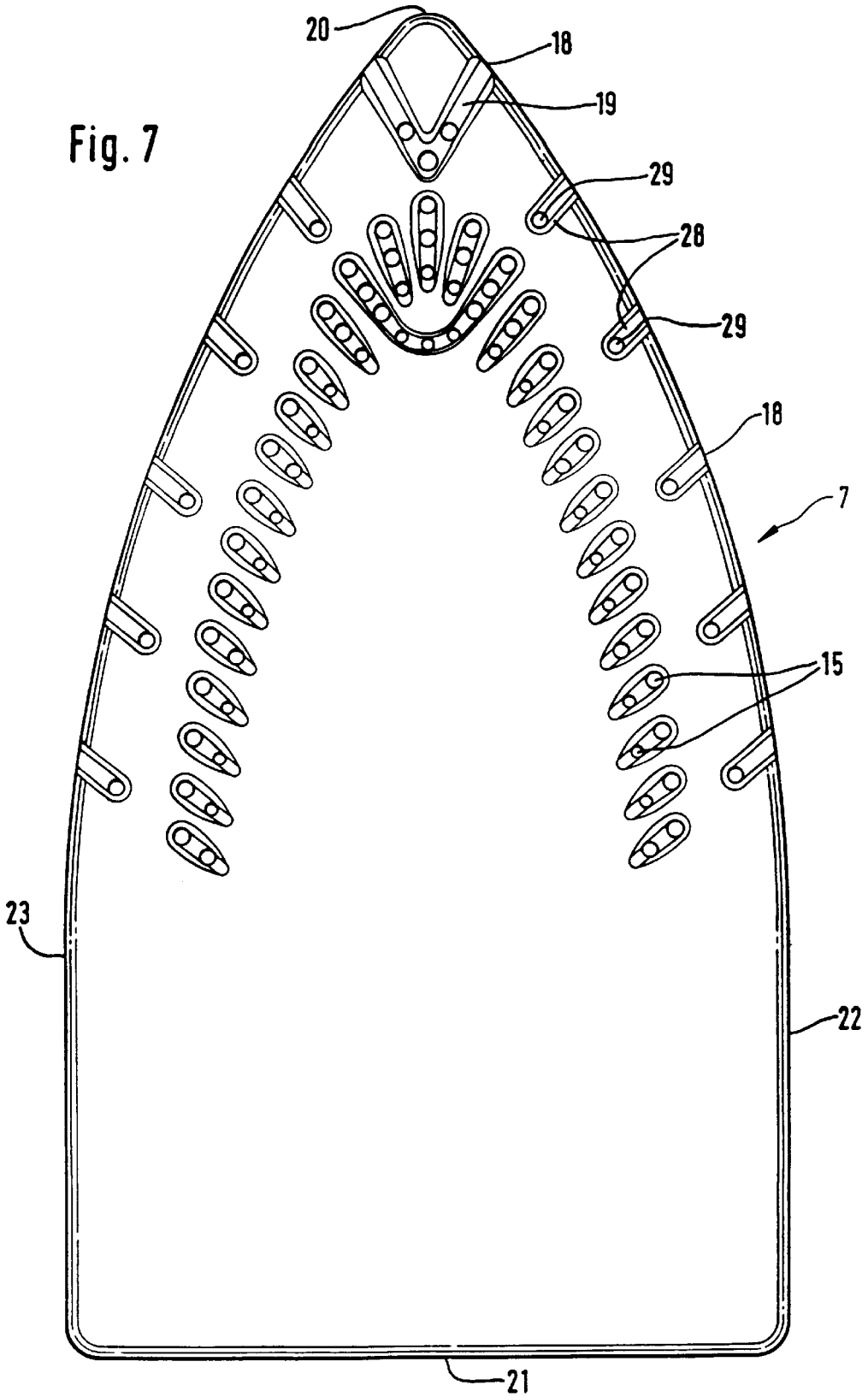
FIG. 7 is a bottom plan view of the ironing surface of a soleplate according to a seventh embodiment of the present invention.

Similar to all of the soleplates described in the foregoing, the soleplate 7 of FIG. 7 has second steam discharge ports 15 which in combination are arranged in a V- or U-shaped configuration, with the tip of the V or the rounding of the U pointing at the iron's nose 20. Three foremost drop-shaped grooves are provided each accommodating three drilled second steam discharge ports 15 in the nose area. In the direction away from the iron's nose 20, there follow two opposed drop-shaped grooves each accommodating three bores for second steam discharge ports, the grooves being combined to form a common approximately V-shaped groove receiving therein a total of nine second steam discharge ports 15. The tip of this V-shaped groove supplying solely steam under the steam iron is arranged to face away from the iron's nose 20, that is in mirror symmetry thereto. This enables particularly powerful steaming beneath the soleplate in the nose area. Moreover, a particularly distinguishing feature of the soleplate 7 is that the entire middle area and a large rear area remote from the iron's nose 20 and close to the rear outer edge 21 form a large final drying zone without any steam discharge port. Along the length of the soleplate 7 from the iron's nose 20 to the rear outer edge 21 adjacent to which the iron has its heel rest, this soleplate 7 has a steaming zone for steam under the iron and for surface steam which is located substantially in the forward half only, that is, the half close to the iron's nose 20. The sides 22, 23 of the outer contour of the soleplate 7 immediately adjoining the iron's nose 20 have an area tapering towards each other in the direction of the iron's nose 20. The first and second steam discharge ports are arranged essentially only in this "tapering" area of the soleplate 7. To provide surface steam, a V-shaped groove 19 is provided on the soleplate 7 in the immediate vicinity of the iron's nose 20 similar to the V-shaped grooves in the previously described soleplates, plus five short grooves or recesses 28 on either side. Steam is supplied to the V- shaped groove 19 through three second steam discharge ports 15, so that a particularly high quantity of steam exiting through the first steam discharge ports 18 of the V-shaped groove 19 impinges on an area directly around the iron's nose 20. On either side of the sides 22 and 23 adjoining the iron's nose, the short grooves 28 extend from the outer contour inwardly (for a length of about 1 cm) towards the center of the ironing surface, being disposed, similar to the grooves 19, 24, 25, 26 described in the foregoing, at such an angle to the outer contour 22, 23 of the sides adjoining the iron's nose 20 as to produce a steam direction component forwardly towards the iron's nose 20 and a steam direction laterally forwardly. The purpose of this arrangement is to provide surface steam only to the area most proximal to the patch ironed over for the first time, viewed in the direction of movement.

The direction of movement is understood to mean the direction in which the iron is moved, which is directly ahead of the iron's nose 20 or directly contiguous with the areas of the soleplate adjacent to the nose and lies in front of these areas. It is in this area lying laterally in front of the soleplate that the material being ironed is exposed to surface steam by the arrangement of the first steam discharge ports 18 and the alignment of the grooves 19, 24, 25, 26, 28. It will be understood, of course, that the iron is movable in any direction, the preferred direction being the direction of movement referred to in the foregoing which is the one in which the material is customarily ironed over for the first time. Succeeding the foremost three drop-shaped grooves for the second steam discharge port 15, the short grooves 28 are aligned with every third successive drop-shaped groove. The short grooves 28 have in their inward end area a second steam discharge port 29 providing steam under the iron in addition to supplying surface steam along the short groove 28 and through the first steam discharge port 18. Preferably, the second steam discharge port 29 is in communication with the steam distribution chamber 16 as is the second steam discharge port 15 in the drop-shaped grooves.

Similar to the soleplate 4, the soleplate 8 is provided with V-shaped grooves 19, with the V-shaped groove 19 closest to the iron's nose 20 having three, and the succeeding V-shaped groove having nine second steam discharge ports. As in the preceding grooves for surface steam, also in this embodiment the V-shaped grooves are approximately equidistantly spaced from each other and arranged in a forward area relative to the nose. The first V-shaped groove 19 in the immediate vicinity of the iron's nose 20 defines between its legs an angle of about 60°, its half angle 30 then being 30°. This angle between the legs of the V-shaped groove 19 progressively increases a small amount from groove 19 to groove 19 rearwardly relative to the direction of movement, so that an angle 31 greater than 50° is formed between the longitudinal center line 50 of the soleplate and the center line 49 passing through the groove 19 of a leg of the V-shaped groove. This results in a uniform distribution of surface steam around the forward part of the soleplate viewed in the direction of movement. A representative section taken through one of the grooves 19 along the longitudinal axis, that is, the axis of symmetry 50, of the soleplate 8 (see FIG. 8*a*) shows how the groove is formed by pressing into the aluminum sheet material. A groove depth 32 of at least 1 mm is sufficient to ensure that the first and the second steam discharge port are in balanced-pressure communication with each other, regardless of the type of fabric involved. The groove width 33 in a bottom area is preferably between 2 and 4 mm, and between 3 and 5 mm in the area contacting the material being ironed (this width being identified by reference numeral 34 in FIG. 8*a*).

FIG. 8*b* shows a section through the groove 19 in the area close to the first discharge port 18, from which it will be seen that the bevel in the groove, meaning the groove's width dimension on the soleplate surface adjacent to the material being ironed, widens relative to the groove cross section of FIG. 8*a*, so that the dimension 35 is preferably between 4 and 6 mm. This rounding 37 which is more pronounced than the rounding 36 of FIG. 8*a* prevents parts which protrude from the article being ironed from catching on the groove 19 or the first steam discharge port 18 alongside the outer contour.

In the embodiments of FIGS. 9, 10 and 11, the surface steam exits through a bevel 38 on the outer contour of the soleplate. It is of particular importance that the bevel itself is configured as a plane surface where each point on the surface forms the same acute angle with the remaining essentially plane ironing surface 39 of the soleplate 9, 10, 11. In contrast to a rounded outer contour for surface steam, the bevel with its acute angle to the article being ironed is capable of ensuring a shallow propagation of surface steam without major losses of steam occurring upwards into the air. The bevels 38 enable a highly uniform and shallow propagation of surface steam.

The soleplate 9 illustrated in FIG. 9*a* represents two embodiments at the same time. Although in FIG. 9*a* the left-hand bevel is provided with relatively spaced first steam discharge ports 18 of a circular configuration while the right-hand bevel includes several relatively spaced first steam discharge ports 18 of a slotted configuration, it should be understood that the bevels arranged in mirror symmetry are equipped with like first steam discharge ports 18, accordingly having either only circular openings or only slotted openings. Instead of being beveled, the iron's nose 20 and the immediately adjoining ironing surface 39 are plane, enabling the area around the nose to continue being utilized as slim pointed tip for hard to reach areas on the material being ironed. At its end directly adjoining the iron's nose, the bevel 38 is arranged close to the outer contour, extending as far as to about mid-way or two thirds of the soleplate's length, starting from the iron's nose 20.

As becomes apparent from FIG. 9*b* illustrating a front elevation of the soleplate 9, the bevel 38 extends from the ironing surface 39 upwardly in the direction of the iron's handle by an amount of between 1 to 4 mm, approximately, preferably 1 to 2 mm (see dimension 40 in FIG. 9*b*). The second steam discharge ports 15 are arranged in drop-shaped grooves conventionally without the provision of a groove connection to the first steam discharge port in the soleplate 9. Both steam discharge ports are in continuous balanced pressure communication with each other, for example through the steam distribution chamber 16 in the interior of the shoe 13, thus using the same steam supply path.

FIG. 10*a* shows an embodiment similar to the embodiments of FIG. 9*a*. Therefore, only features differing therefrom will be described with reference to this embodiment. Instead of having openings in the bevel, the soleplate 10 is provided with elongated grooves 41 providing, similar to the soleplate 2, for steam communication between the first and the second steam discharge port 18, 15. The elongated groove 41 extends the drop-shaped groove for the second steam discharge ports 15 outwardly towards the outer contour of the soleplate up to the bevel, so that the steam escapes over the bevel as surface steam. In this embodiment, the first steam discharge port 18 is provided between the material being ironed and the gap formed by the bevel along the two sides adjoining the iron's nose. In this arrangement which is again in mirror symmetry to the longitudinal axis of symmetry, four elongated grooves 41 are equidistantly spaced apart on either side. The bevel 38 has a width of 4 to 6 mm, approximately. In all embodiments, the bevels 38 are invariably dimensioned such that the first steam discharge port 18 is at all times in balanced pressure communication with the second steam discharge port 15, regardless of the type of fabric being ironed.

FIG. 11*a* shows a soleplate 11 in which the second steam discharge ports 15 are arranged in conventional manner as described in the foregoing. The first steam discharge port 18 is formed by a gap between the bevel 43 and the material being ironed. The bevel 43 extends in the direction of the central region of the soleplate 11 such an amount that at least the three drop-shaped grooves for the second steam discharge port 15 located closest to the iron's nose 20 partially reach into the bevel, thereby establishing a steam connection between the first and the second steam discharge port. The bevel 43 combines with the article being ironed to form a first steam discharge port 18 which, in contrast to all other embodiments reaches as far as into an area including the iron's nose 20. This provides the soleplate 11 with a beveled slim pointed tip which, taken alone, may become the subject-matter of a patent application as other aspects of this application likewise. The bevel 43 extends from the iron's nose in the direction of the opposite end for a length of between one fifth and one third of the overall length from the nose to the rear end of the soleplate. Thus a slim pointed tip is integrally formed with which it is possible, by tilting the iron slightly, to iron solely in the forward area around the tip without the areas rearwardly thereof contacting the remaining ironing surface 39 which, if they did, would entail the risk of undesired creases being pressed into the fabric, while the beveled slim pointed tip enables hard to reach areas to be ironed. During normal operation of the iron in which the ironing surface 39 is in contact with the material being ironed, the bevel 43 has the effect that the iron's nose is raised clear of the material being ironed, so that the surface steam propagates particularly intensively and efficiently in a foremost area around the iron's nose 20. The bevel 43 extends along the axis of symmetry 50 towards the ironing surface 39 for a length of a few centimeters.

FIG. 11*b* shows a side view of the soleplate 11 absent any other components of the iron. The bevel 43 of the slim pointed tip which, taken alone, is of a plane configuration, is inclined at an angle of 3° to 6° relative to the imaginary extension of the remaining plane ironing surface 39. This inclination is sufficient to ensure a continuous balanced pressure communication between the first and the second steam discharge port, regardless of the material being ironed. Further, the relatively small angle 44 dictates a direction of steam flow enabling the surface steam to propagate in very close proximity to the surface. However, the ironing surface 39 and the bevel 38, 43 define between them an angle of at least 130°.

FIG. 12*a* shows, as initially described, a soleplate 12 in which second steam discharge ports are arranged in conventional manner. In this embodiment the first steam discharge ports 18 are recognizable only in the side view of the soleplate illustrated in FIG. 12*b*, because they are configured as relatively spaced lateral slots or other, for example circular, openings in the bent side wall of the soleplate. This embodiment ensures a conventional uniform ironing surface as is customary with prior irons, with the particular feature however that surface steam is able to exit through the first steam discharge ports 18 laterally alongside the outer contour. Preferably, four lateral slots are formed approximately in the outermost area of the soleplate 12 on either side 22, 23. The first steam discharge ports 18 are situated in the forward third of the soleplate 12 close to the iron's nose 20, and no slotted opening is desirable directly in the area of the nose to prevent fabric from catching on it during ironing. The first steam discharge port 18 lying closest to the iron's nose nevertheless ensures that at the prevailing steam pressure the surface steam propagates as far as directly ahead of the iron's nose 20.

As shown in FIG. 12*c* illustrating a partial sectional view of the shoe and the soleplate, this embodiment provides for the balanced pressure communication between the first and the second steam discharge port by means of grooves, conduits or slots 45 or the like in the shoe 13, so that the first steam discharge ports 18 are in steam communication with the steam distribution chamber 16.

FIG. 13 shows a perspective top plan view of a soleplate 46 configured as an attachment to a conventional steam iron. By attaching this soleplate 46 to the soleplate fixedly secured to the steam iron, an iron is available which has the added provision of first steam discharge ports for surface steam. Directly beneath the second steam discharge port 15 of the steam iron (in assembled condition with the soleplate 46), the soleplate attachment 46 has second steam discharge ports 47. The second steam discharge ports 47 are of an approximately rectangular or, in the nose area, V-shaped configuration as a result of which the steam under the iron is undiminished as it is passed on to the material being ironed. Channels 48 are provided to establish steam communication from the second steam discharge ports to the first steam discharge ports. The channels 48 are oriented in a way similar to the grooves 24 of the soleplate 2, however, they may also be arranged on the side facing away from the ironing surface of the soleplate attachment 46 so that with the soleplate attachment 46 mounted on the steam iron the first steam discharge ports 18 are at a height of a few millimeters above the ironing surface similar to the embodiment of FIG. 12*b*.

FIG. 14 shows schematically a soleplate 52 which corresponds to one of the soleplates described in the foregoing. The schematically illustrated soleplate 52 includes a nose 20, immediately adjacent thereto sides 22 and 23, and a side 21 of the outer contour at the end remote from the nose. FIG. 14 serves for clarification of the propagation of the surface steam which is provided in an area around the nose, that is, ahead of and adjacent thereto, as well as in an area forward of the adjoining sides 22 and 23. In some embodiments, for example in the embodiment of FIG. 11*a*, the steam cloud for surface steam does not extend as far as shown in FIG. 14, covering an area of only about one fourth from the iron's nose towards the rear. Preferably, the first steam discharge port extends in a forward area, proceeding from the iron's nose to the rear for a length of one fifth to two thirds of the overall length, providing at least in the rear area of the soleplate at the end close to the iron's heel rest a drying zone covering an area of at least one seventh to one half of the overall length of the soleplate, whereby it is ensured that the material being ironed is not only well dampened by steaming but also sufficiently dried.

What is claimed is:

1. A steam iron with a water reservoir for the supply of water to an evaporation chamber in which the fed water is convertible into steam and which is connectable to at least one first and one second steam discharge port (18, 15), with a heating element (14) for heating both the evaporation chamber and a soleplate (1, 2, 3, 4, 5, 6, 7, 8, 9, 10, 11, 12, 46), said soleplate having an ironing surface (39) and a nose (20) at its forward end when viewed in the direction of movement, and said first steam discharge port (18) being arranged in such close proximity to the iron's nose (20) that the steam propagates in the area adjacent to the iron's nose (20), characterized in that the first and the second steam discharge port (18, 15) are formed in the soleplate (1, 2, 3, 4, 5, 6, 7, 8, 9, 10, 11, 12, 46), and that the first and the second steam discharge port (18, 15) are in balanced pressure communication with each other, irrespective of the material being ironed.

2. A steam iron with a water reservoir for the supply of water to an evaporation chamber in which the fed water is convertible into steam and which is connectable to at least one first and one second steam discharge port (18, 15), with a heating element (14) for heating both the evaporation chamber and a soleplate (1, 2, 3, 4, 5, 6, 7, 8, 9, 10, 11, 12, 46), said soleplate having an ironing surface (39) and a nose (20) at its forward end when viewed in the direction of movement, and said first steam discharge port (18) being arranged in such close proximity to the iron's nose (20) that the steam propagates in the area adjacent to the iron's nose, characterized in that the first and the second steam discharge port (18, 15) are arranged at a height of less than 10 mm relative to the ironing surface (39), in particular at a height of less than 5 mm, and that the first steam discharge port(s) (18) is/are arranged such that the steam exits solely adjacent to the iron's nose (20) and adjacent to the sides (22, 23) contiguous with the nose (20), as a result of which the material being ironed is dampened solely adjacent to the steam iron at the iron's nose (20) and at the two sides (22, 23) directly contiguous therewith.

3. The steam iron according to claim 1 or 2, characterized in that the second steam discharge port (15) is arranged within the substantially plane ironing surface (39), the steam thus exiting through the second steam discharge port (15) under the steam iron, dampening the article being ironed.

4. The steam iron according to claim 1 or 2, characterized in that the first steam discharge port (18) and/or the second steam discharge port (15) are in uninterrupted communication with the evaporation chamber.

5. The steam iron according to claim 1 or 2, characterized in that the first steam discharge port (18) is in communication with the second steam discharge port (15) through a groove (19, 24, 25, 26, 41, 48) on the ironing surface, and that said groove (19, 24, 25, 26, 41, 48) opens into the first steam discharge port (18).

6. The steam iron according to claim 5, characterized in that an imaginary center line (49) between the first and the second steam discharge port (18, 15) through the groove (19, 24, 25, 26, 41, 48) forms an acute angle (30, 31) with an imaginary line of symmetry (50) through the iron's nose (20) and the center of the ironing surface, so that the steam exiting from the first steam discharge port (18) is directed laterally forwardly when viewed in the direction of movement.

7. The steam iron according to claim 6, characterized in that the groove (19, 24, 25, 26, 41, 48) extends crosswise over the soleplate (1, 2, 3, 4, 5, 6, 7, 8, 9, 10, 11, 12, 46) from the first steam discharge port (18) to a further first steam discharge port (18) on the opposite side of the soleplate (1, 2, 3, 4, 5, 6, 7, 8, 9, 10, 11, 12, 46), said groove (19, 24, 25, 26, 41, 48) extending in a V- or W-shaped configuration.

8. The steam iron according to claim 1 or 2, characterized in that several second steam discharge ports (18) are provided which are arranged in an essentially V-shaped configuration, with the tip of the V pointing at the iron's nose (20).

9. The steam iron according to any one of the claims 1 to 8, characterized in that the first steam discharge port (18) is formed by a bevel (38, 43) provided on the edge of the ironing surface (39).

10. The steam iron according to claim 9, characterized in that the bevel (38, 43) is at an angle of inclination of between 130° and 178°, preferably between 170° and 178°, to the ironing surface (39), so that the steam exits close to the surface of the material being ironed preferably at an angle of between 2° and 10° between the material being ironed and the bevel (38, 43).

11. The steam iron according to claim 9, characterized in that the bevel (38) includes slots or circular orifices for the discharge of steam.

12. The steam iron according to claim 9, characterized in that the bevel (38) extends to the iron's nose (20) only such an amount that the ironing surface (39) of the soleplate (1, 2, 3, 4, 5, 6, 7, 8, 9, 10, 11, 12, 46) continues to be plane up to the nose (20) and around the nose (20), with the first steam discharge port (18) being arranged adjacent to this area.

13. The steam iron according to claim 1 or 2, characterized in that the first steam discharge port (18) is provided above the ironing surface (39) and on the side of the soleplate (12, 46).

14. The steam iron according to claim 1 or 2, characterized in that provision is made for the soleplate (46) or an additional soleplate in which the first or/and second steam discharge port (18, 15, 47) is formed, to be demountable from and attachable to the steam iron.

15. The steam iron according to claim 1 or 2, characterized in that solely steam discharge ports (18, 15) are provided that deliver steam laterally around the soleplate (1, 2, 3, 4, 5, 6, 7, 8, 9, 10, 11, 12, 46).

16. The steam iron according to claim 1 or 2, characterized in that the at least one first steam discharge port extends from the iron's nose (20) to either side for a length of about one fifth to two thirds of the entire lateral contour length of each side (22, 23) of the soleplate (1, 2, 3, 4, 5, 6, 7, 8, 9, 10, 11, 12, 46) adjoining the iron's nose (20).

17. The steam iron according to claim 1 or 2, characterized in that an area of the soleplate (1, 2, 3, 4, 5, 6, 7, 8, 9, 10, 11, 12, 46) from the side (21) remote from the iron's nose (20) is devoid of steam discharge ports (15, 18), said area covering one seventh to one half of the overall length from the iron's nose to the opposite end (21), so that in the rear portion of the ironing surface, when viewed in the direction of movement, a drying zone is formed for drying the material being ironed without dampening.

* * * * *

UNITED STATES PATENT AND TRADEMARK OFFICE

CERTIFICATE OF CORRECTION

PATENT NO. : 6,216,369 B1

DATED : April 17, 2001
INVENTOR(S) : Jurgen Wolf, Antonio Rebordosa, Desideri Falco, Candelario Martinez, Juan Carlos Coronado, Miguel Vazquez-Palma, Remedios Pozo-Marin and Sergi Gili It is certified that error appears in the above-identified patent and that said Letters Patent is hereby corrected as shown below:

Column 3,
Line 48, delete “features of claim 1” and insert therefor -- features of the invention --.
Line 48, delete “, and with a steam iron incorporating the features of claim 2”.

Replace claims 1-17 with the following claims 1-21:

-- 1. A steam iron comprising:

a soleplate having an ironing surface, a nose at its forward end, a trailing edge at its back end, two sides opposite each other and extending from the nose toward the trailing edge, a plurality of first steam discharge ports and a plurality of second steam discharge ports formed in the soleplate, and a plurality of channels connecting the plurality of first steam discharge ports to the plurality of second steam discharge ports;

an evaporation chamber in which water is convertible into steam and which is connectable to the plurality of first steam discharge ports and to the plurality of second steam discharge ports;

a heating element for heating both the evaporation chamber and the soleplate, wherein said plurality of first steam discharge ports is arranged in such close proximity to the soleplate’s nose that surface steam propagates in an area outside of and adjacent to the soleplate’s nose, wherein the plurality of first steam discharge ports is arranged on an outer peripheral edge of the soleplate for directing the steam adjacent to the outer periphery of the soleplate rather than under the soleplate, wherein during use the plurality of first steam discharge ports and the plurality of second steam discharge ports are by reason of the plurality of channels in balanced steam pressure communication with each other, irrespective of the material being ironed, and wherein there are no steam discharge ports along the trailing edge of the soleplate.

It is certified that error appears in the above-identified patent and that said Letters Patent is hereby corrected as shown below:

2. A steam iron comprising:

a soleplate having an ironing surface, a nose at its forward end when viewed in the direction of movement, a trailing edge at its back end, two sides opposite each other and extending from the nose toward the trailing edge, a plurality of first steam discharge ports and a plurality of second steam discharge ports formed therein, and a plurality of channels connecting the plurality of first steam discharge ports to the plurality of second steam discharge ports;

an evaporation chamber in which water is convertible into steam and which is connectable to the plurality of first steam discharge ports and to the plurality of second steam discharge ports;

a heating element for heating both the evaporation chamber and the soleplate wherein the plurality of first steam discharge ports and the plurality of second steam discharge ports are arranged at a height of less than 10 mm relative to the ironing surface, and the plurality of first steam discharge ports are arranged around the periphery of the soleplate in the vicinity of the nose and along both sides of the soleplate that are contiguous to the nose so that the plurality of first discharge ports during use ejects surface steam which exits out from around the periphery of and away from the soleplate and solely in a region that is adjacent to the soleplate's nose and adjacent to sides of the soleplate that are contiguous with the nose, as a result of which during use material being ironed is dampened by surface steam solely in a region that is adjacent to the steam iron at the soleplate's nose and at the two sides directly contiguous therewith.

3. The steam iron according to claim 1 or 2, wherein the ironing surface is substantially planar and the plurality of second steam discharge ports are arranged within the substantially plane ironing surface, the steam thus exiting during use through the plurality of second steam discharge ports under the steam iron, dampening the article being ironed.

4. The steam iron according to claim 1 or 2, wherein the plurality of first steam discharge ports and/or the plurality of second steam discharge ports are in uninterrupted communication with the evaporation chamber.

5. The steam iron according to claim 1 or 2, wherein the channels of the plurality of channels are grooves on the ironing surface, and the grooves open into the plurality of first steam discharge ports.

It is certified that error appears in the above-identified patent and that said Letters Patent is hereby corrected as shown below:

6. The steam iron according the claim 5, wherein a first one of the first steam discharge ports and a first one of the second steam discharge ports are connected to each other by one of the grooves and wherein said one of the grooves defines an imaginary center line extending between the first and the second steam discharge ports connected thereby, and wherein said imaginary line forms an acute angle with an imaginary line of symmetry through the soleplate's nose and the center of the ironing surface, so that the steam exiting from said first one of the first steam discharge ports is directed laterally forwardly when viewed in the direction of movement.

7. The steam iron according to claim 6, wherein said one of the grooves extends crosswise over the soleplate from said first one of the first steam discharge ports to a further one of the first steam discharge ports on an opposite side of the soleplate, said one of the grooves extending in a V- or W-shaped configuration.

8. The steam iron according to claim 1 or 2, wherein several of the plurality of second steam discharge ports are arranged in an essentially V-shaped configuration, with the tip of the V pointing at the iron's nose.

9. The steam iron according to any one of the claims 1 or 2, wherein each of the first steam discharge ports is formed by a corresponding bevel provided on one of the edges of the ironing surface.

10. The steam iron according to claim 9, wherein the bevels are at an angle of inclination of between 130° and 178° to the ironing surface, so that the steam exits close to the surface of the material being ironed.

11. The steam iron according to claim 9, wherein the bevels include slots for the discharge of steam.

12. The steam iron according to claim 9, wherein the bevels extend to the soleplate's nose only such an amount that the ironing surface of the soleplate continues to be plane up to the nose and around the nose, with the plurality of first steam discharge ports being arranged adjacent to this area.

13. The steam iron according to claim 1 or 2, wherein the plurality of first steam discharge ports is provided above the ironing surface and on the sides of the soleplate.

It is certified that error appears in the above-identified patent and that said Letters Patent is hereby corrected as shown below:

14. The steam iron according to claim 1 or 2, wherein provision is made for the soleplate in which the plurality of first and second steam discharge ports is formed, to be demountable from and attachable to the steam iron.

15. The steam iron according to claim 1 or 2, wherein only steam discharge ports are provided that deliver steam laterally around the soleplate.

16. The steam iron according to claim 1 or 2, wherein one of the plurality of first steam discharge ports extends from the soleplate's nose along one side of the soleplate for a length of about one fifth to two thirds of the entire lateral contour length of that side of the soleplate adjoining the soleplate's nose.

17. The steam iron according to claim 1 or 2, wherein an area of the soleplate that is adjacent to the trailing edge and remote from the soleplate's nose is devoid of any steam discharge ports, said area covering one seventh to one half of the overall length from the soleplate's nose to the trailing edge, so that in the rear portion of the ironing surface, when viewed in the direction of movement, a drying zone is formed for drying the material being ironed without dampening.

18. The steam iron according to claim 2 wherein the plurality of first steam discharge ports and the plurality of second steam discharge ports are arranged at a height of less than 5 mm relative to the ironing surface.

19. The steam iron according to claim 9, wherein the bevels are at an angle of inclination of between 170° and 178° to the ironing surface, so that the steam exits close to the surface of the material being ironed.

20. The steam iron according to claim 9, wherein the bevels are at an angle of inclination of between 130° and 178° to the ironing surface, so that the steam exits close to the surface of the material being ironed at an angle of between 2° and 10° between the material being ironed and the bevel.

UNITED STATES PATENT AND TRADEMARK OFFICE

CERTIFICATE OF CORRECTION

PATENT NO. : 6,216,369 B1 
DATED : April 17, 2001
INVENTOR(S) : Jurgen Wolf, Antonio Rebordosa, Desideri Falco, Candelario Martinez, Juan Carlos Coronado, Miguel Vazquez-Palma, Remedios Pozo-Marin and Sergi Gili It is certified that error appears in the above-identified patent and that said Letters Patent is hereby corrected as shown below:

21. The steam iron according to claim 9, wherein the bevels include circular orifices for the discharge of steam. --

Signed and Sealed this

Fifteenth Day of October, 2002

*Attest:*

*Attesting Officer*

JAMES E. ROGAN
*Director of the United States Patent and Trademark Office*